United States Patent [19]

Strong et al.

[11] Patent Number: 4,649,783

[45] Date of Patent: Mar. 17, 1987

[54] WAVETABLE-MODIFICATION INSTRUMENT AND METHOD FOR GENERATING MUSICAL SOUND

[75] Inventors: Alexander R. Strong, Willington, Conn.; Kevin J. Karplus, Ithaca, N.Y.

[73] Assignee: The Board of Trustees of the Leland Stanford Junior University, Palo Alto, Calif.

[21] Appl. No.: 614,404

[22] Filed: May 24, 1984

Related U.S. Application Data

[63] Continuation-in-part of Ser. No. 463,270, Feb. 2, 1983.

[51] Int. Cl.[4] ..... G10H 1/00

[52] U.S. Cl. ..... 84/1.01; 84/1.19

[58] Field of Search ..... 84/1.01, 1.19; 381/28, 381/32, 63

[56] References Cited

U.S. PATENT DOCUMENTS 4,105,864 8/1978 Berkovitz ..... 381/63

4,121,058 10/1978 Jusko et al. ..... 381/32

4,275,267 6/1981 Kurtin et al. ..... 381/28

4,281,574 8/1981 Deutsch ..... 84/1.19

4,351,218 9/1982 Deutsch ..... 84/1.19

*Primary Examiner*—William M. Shoop, Jr.

*Assistant Examiner*—Sharon D. Logan

*Attorney, Agent, or Firm*—Fliesler, Dubb, Meyer & Lovejoy

[57] ABSTRACT

A musical instrument employing probabilistic wavetable-modification method of producing musical sound. A randomly initialized wavetable which is periodically accessed to provide an output signal which determines the musical sound. The output signal from the wavetable is probabilistically modified and stored back into the wavetable as modified data. The modified data, after a delay, is accessed from the wavetable and thereby becomes a new output signal. This process is periodically repeated whereby each new output signal is stored (after possibly being modified) back into the wavetable to produce rich and natural musical sound.

44 Claims, 6 Drawing Figures

WAVETABLE-MODIFICATION INSTRUMENT AND METHOD FOR GENERATING MUSICAL SOUND

This application is a continuation-in-part of the application entitled WAVETABLE-MODIFICATION INSTRUMENT AND METHOD FOR GENERATING MUSICAL SOUND, Ser. No. 463,270 filed Feb. 2, 1983.

BACKGROUND OF THE INVENTION

This invention relates to musical instruments and more specifically to digitally controlled electronic instruments and methods for generating musical sound.

Digitally controlled methods of generating musical sound operate by producing a sequence of digital numbers which are converted to electrical analog signals. The analog signals are amplified to produce musical sound through a conventional speaker. Musical instruments which employ digital control are constructed with a keyboard or other input device and with digital electronic circuits responsive to the keyboard. The electronic circuits digitally process signals in response to the keyboard and digitally generate oscillations which form the sound in the speaker. These digitally generated oscillations are distinguished from oscillations generated by analog oscillators and are distinguished from mechanically induced oscillations produced by conventional orchestral and other type instruments.

All musical sounds, whether of electronic or mechanical origin, can be described by Fourier spectra. The Fourier spectra describes musical sound in terms of its component frequencies which are represented as sinusoids. The whole musical sound is, therefore, a sum of the component frequencies, that is, a sum of sinusoids.

Under Fourier analysis, tones are classified as harmonic or inharmonic. A harmonic tone is periodic and can be represented by a sum of sinusoids having frequencies which are integral multiples of a fundamental frequency. The fundamental frequency is the pitch of the tone. Harmonic instruments of the orchestra include the strings, the brasses, and the woodwinds. An inharmonic tone is not periodic, although it often can be represented by a sum of sinusoids. The frequencies comprising an inharmonic tone, however, usually do not have any simple relationship. Inharmonic instruments do not normally have any pitch associated with them. Instruments in the orchestra that are inharmonic include the percussion instruments, such as the bass drum, the snare drum, the cymbal and others.

Electronically controlled musical instruments have relied upon forming selected Fourier spectra as a basis for producing musical sound. One known type of digital musical instrument employs a harmonic summation method of music generation. In the harmonic summation method, a tone is produced by adding (or subtracting) a large number of amplitude-scaled sinusoids of different frequencies. The harmonic summation method, therefore, requires a large number of multiplications and additions to form each sample. That process requires digital circuitry which is both expensive and inflexible. Accordingly, the digital design necessary to carry out the method of harmonic summation is computationally complex and leaves much to be desired.

Another known type of musical instrument employs the filtering method of music generation. In the filtering method, a complex electrical waveform, such as a square wave or a saw-tooth pulse train, is filtered by one or more filters to select the desired frequency components. Thereafter, the filtered frequency components are combined to form the electrical signal which drives the speaker. The filtering method is commonly used to synthesize human speech and has often been used with analog electronic organs. The filtering method is comparatively inflexible since each sample relies upon the stored values of fixed samples. In order to achieve natural sound, the filtering method requires a large number of multiplication steps which are economically expensive to achieve.

In a typical example of a filter technique, a waveshape memory provides digital samples of one cycle of a waveshape to a loop circuit which includes a filter and a shift register. The digital waveshape samples read out from the waveshape memory are caused to circulate at a predetermined rate of time in the loop circuit. A output from the loop circuit varies as time lapses, and is utilized as a musical tone.

The classical filter techniques result in systems in which the pitch frequency $f_s/N$, is determined by division using an integer, N, and hence desirable variations due to non-integral division are not achieved.

In many prior art systems, the divisor, N, is forced to be an integer when shift-register or other fixed circuits are employed. Also, the integer is further limited to some power of 2 in order to facilitate processing. In order to vary the pitch, $f_s/N$, the frequency $f_s$ must be varied. Such systems, however, cannot be extended readily and economically to multi-voice embodiments because, for example, each voice requires a different frequency, $f_s$.

Both the harmonic summation and the filtering methods rely upon a linear combination of sinusoids and, hence, they are characterized as linear methods for generating musical sound. The linear property is apparent from the fact that multiplying the amplitude of the input function (sinusoids for harmonic summation or a pulse train for filtering) by a factor of two results in an output waveform with the same tone quality and with an amplitude multiplied by a factor of two.

U.S. Pat. No. 4,018,121 entitled METHOD OF SYNTHESIZING A MUSICAL SOUND to Chowning describes a non-linear method for generating musical sound. That nonlinear method employs a closed-form expression (based upon frequency modulation) to represent the sum of an infinite number of sinusoids. That non-linear frequency modulation method produces a number of sinusoids which have frequencies which are the sum of the carrier frequency and integral multiples of the modulation frequency. The amplitudes of the multiples of the modulation frequency are sums of Bessel functions. The non-linear frequency modulation method of Chowning is an improvement over previously used linear harmonic summation and filtering methods, and has found commercial application in music synthesizers.

U.S. Pat. No. 4,215,617 entitled MUSICAL INSTRUMENT AND METHOD FOR GENERATING MUSICAL SOUND to Moorer describes improved non-linear methods of musical sound generation in which the amplitudes of frequency components are not constrained to the Bessel functions and in which finite spectra can be utilized, that is, spectra composed of the sum of a finite number of sinusoids.

In general, prior art methods of musical sound generation have employed deterministic techniques. Typically, the methods rely upon an input sample which has fixed parameters which specify the musical sound to be generated. Such input samples when processed by a predetermined method result in a deterministic output signal which does not have the rich, natural sound of more traditional instruments.

While many linear and non-linear methods, like those described above, have been used with success for digital musical synthesis, they all have required fast and complex computational capability typically involving several multiplication steps per sample in order to achieve rich, natural sounds. Such fast and complex computational capability results in musical instruments of high cost and complexity. This high cost and complexity has impeded the widespread availability of digital synthesis.

Accordingly, there is a need for improved musical instruments employing digital synthesis which can be used with digital circuits requiring slower and less complex computational capability than that required by prior techniques, but which still produce rich and natural sounds. There is also a need for improved digital music synthesizers which can be constructed using conventional computer processors and conventional semiconductor chip technology.

In accordance with the above background, it is an objective of the present invention to provide an improved musical instrument and method of generating rich and natural musical sounds utilizing simple and conventional digital circuitry which does not require computational complexity.

SUMMARY OF THE INVENTION

The present invention is a musical instrument and method employing probabilistic wavetable-modification for producing musical sound. The musical instrument includes a keyboard or other input device, a wavetable-modification generator for producing digital signals by probabilistic wavetable modification, and an output device for converting the digital signals into musical sound.

The generator includes a wavetable which is periodically accessed to provide an output signal which determines the musical sound. The output signal from the wavetable can be modified and is stored back into the wavetable directly or as modified data. A decision is made stochastically whether to modify the output signal before it is stored back into the wavetable. At some later time, the possibly modified stored signal is again accessed and thereby becomes a new output signal. This process is periodically repeated whereby each new output signal is stored (after possibly being modified) back into the wavetable. The output signals are thus generated by probabilistic wavetable modification, in accordance with the present invention, and are used to produce rich and natural musical sound.

In accordance with the present invention, at any time t, the signal $y_t$ which is stored back into the wavetable is a function of the result $v_t$ of accumulated modifications of the original contents $x_t$ of the wavetable, and a current modification component $m_t$. Therefore, the signal $y_t$ is a function of $v_t$ and $m_t$ as follows:

$$y_t = f(v_t, m_t)$$

In a digital sample embodiment, the $n^{th}$ sample of $y_t$ is given as $y_n$. In general, the $n^{th}$ modification component, $m_n$, is determined stochastically for each sample. For a particular sample n, $m_n$ may be such that no modification is performed. In accordance with one embodiment of the type suitable for generating plucked-string sounds, the modification performed to generate $y_n$ is an average of a first delayed output $y_{n-N}$ and the previous delayed output $y_{n-(N+1)}$.

In the plucked string embodiment, the $n^{th}$ value to be stored into the wavetable is given as follows:

$$y_n = \begin{cases} x_n \text{ for } 0 \leqq n < M; \\ [y_{n-N} + y_{n-(N+1)}]/2 \text{ for } n \geqq M \text{ and } r_n < d; \\ y_{n-N} \text{ for } n \geqq M \text{ and } r_n \geqq d; \end{cases}$$

where:

$x_n$ = $n^{th}$ initial excitation sample $y_n$ = output at $n^{th}$ sample

N = pitch number (approximately the desired period of the tone in samples)

$y_{n-N}$ = sample delayed by N $y_{n-(N+1)}$ = sample delayed by N+1

$r_n$ = a random number uniformly distributed between 0 and 1 which is generated for the $n^{th}$ sample M = duration of initial excitation ("pluck") in samples d = probability of modification ("decay probability")

In the plucked string embodiment, the modification is implemented, for example, as a simple addition and binary shift (divide-by-two) of data stored in a wavetable. The location of data in the wavetable, in one digital memory embodiment, is determined by memory address pointers. A Read Pointer specifies the location of the delayed sample, $y_{n-N}$. A "Read Pointer+1" is offset from the Read Pointer by one and specifies the location of the delayed sample $y_{n-(N+1)}$. The modified value, $y_n$, is stored into the wavetable at a location specified by a Write Pointer. The Write Pointer is offset from the Read Pointer by the pitch number, N.

In a multi-voice embodiment, the pitch number, N, is typically different for each voice. A Read Pointer and a Write Pointer are determined for each voice.

The present invention can be economically implemented and additionally provides a superior result, that is, the pitch frequency need not be divided by an integer, $f_s/N$, but is fractionally different, for example, $f_s/(N+\frac{1}{2})$. The fractional difference between the number N and for example, the number $N+\frac{1}{2}$, introduces small variations in the pitch of the note generated and materially enhances the sound generated by the present invention.

Furthermore, the present invention employs a random access memory wavetable in which the approximate pitch number N maybe different for different voices so that the pitch can be readily changed by merely changing the pointers to locations in the memory.

The present invention employs a random number generator to provide the initial input to the wavetable. The random number initially stored in the memory is unrelated, in general, to the pitch of the desired sound, that is, is unrelated to the pitch number, N.

The wavetable-modification method of the present invention achieves the objective of providing an improved digital instrument which can be implemented with low computational requirements.

The foregoing and other objects, features and advantages of the invention will be apparent from the following more particular description of preferred embodiments of the invention as illustrated in the accompanying drawings.

DETAILED DESCRIPTION

Figure 1:
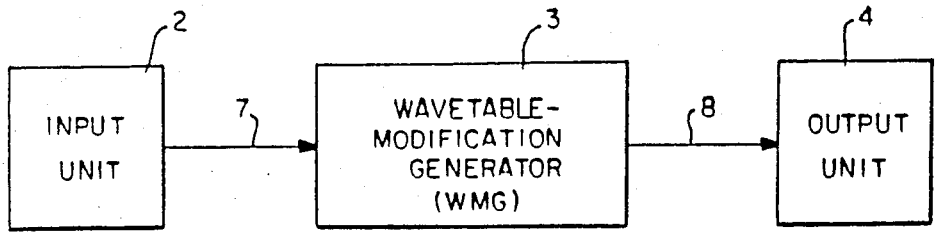
FIG. 1 depicts an electrical block diagram of a musical instrument incorporating the present invention.

In FIG. 1, a digital synthesizer musical instrument is shown. The instrument includes an input unit 2 which specifies a musical sound to be generated, a wavetable-modification generator 3 for generating signals representing the sound to be produced and an output unit 4 for producing the desired sound.

Figure 2:
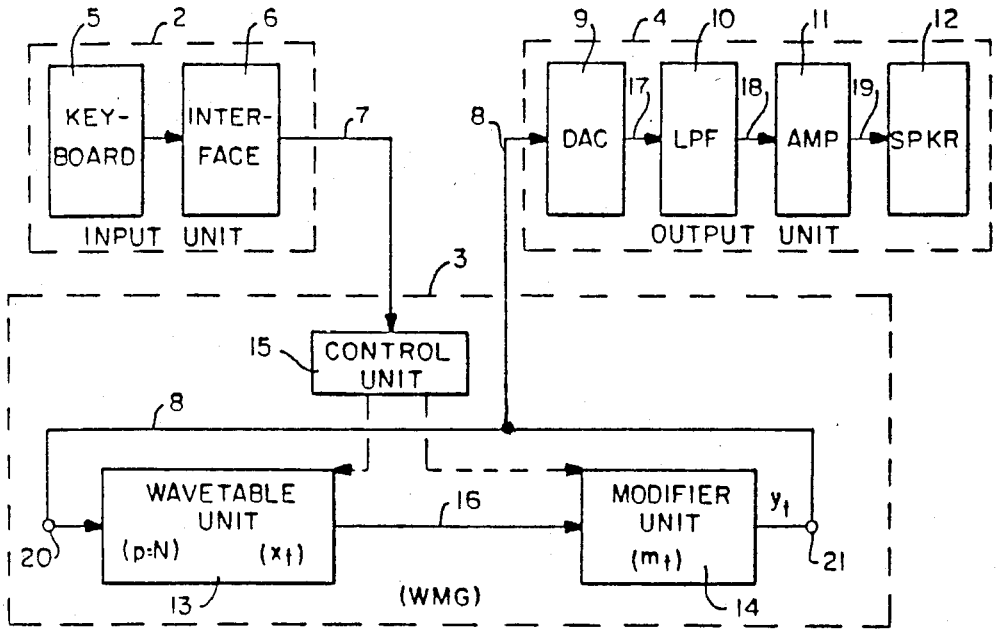
FIG. 2 depicts an expanded electrical block diagram of the FIG. 1 musical instrument.

In FIG. 2, further details of the FIG. 1 instrument are shown. The input unit 2 typically includes a keyboard 5 which connects electrical signals to an interface 6. The keyboard 5 is of conventional design and produces electrical signals representing, among other things, which keys are depressed. While keyboard 5 is a typical device for specifying notes to be played, any other type of input for specifying a note to be played can be employed. Additionally, the input unit 2 typically includes means for specifying the force (amplitude) of the note and the duration of the note to be played.

The interface unit 6 encodes the keyboard information (pitch, amplitude, and duration) and transmits it to the control unit of the wavetable-modification generator 3. The generator 3, in response to the signals from the input unit 2, generates a signal on the output bus 8 which in turn connects to the output unit 4. The output unit 4 converts the signal on bus 8 to the desired musical sound. Typically, the output unit 4 includes a digital-to-analog converter 9. Analog signals output from the converter 9 connect through a low-pass filter 10 and an amplifier 11 to a speaker 12. The speaker 12 produces the desired musical sound.

In FIG. 2, the wavetable-modification generator 3 includes a wavetable 13, a modifier unit 14 and a control unit 15. The wavetable 13 acts like a delay device having a delay time, p. Modified signals from modifier unit 14 are stored in wavetable 13 where they are delayed a period, p, before appearing on bus 16. Output signals from the wavetable on bus 16 are modified in modifier unit 14 and stored in wavetable 13. In a digital implementation, the delay time, p, is represented by N samples of data. As a digital device, wavetable 13 is a digital memory for storing N samples of data. For values of time, t, less than p, the wavetable 13 stores initial values of $x_t$. For a digital system, it is quantized into N values of n so that for initial conditions, $x_n$ has N initial values.

By way of background, the wavetable 13, in the absence of any modification in modification unit 14, will generate an output signal $y_t$ which is periodic with the delay time, p. When the original contents in the wavetable are $x_t$, the output signal, $y_t$, can be expressed as follows:

$$y_t = y_{(t-p)} = x_t \quad (1)$$

If time, t, is quantized to discrete values, n, and p equals N values of n, where N is an integer, and $x_n$ represents N discrete values of $x_t$, when Eq. (1) can be written as follows:

$$y_n = y_{(n-N)} = x_n \quad (2)$$

Thus the initial contents of the wavetable are output repeatedly in a cyclical manner to produce an unchanging, periodic waveform which without modification is not musically satisfactory. Because a modification is usually made by the modification unit 14, Eqs. (1) and (2) do not apply to the output signal utilized in the present invention, except in the special case when the decay probability d is equal to 0.

In accordance with the present invention, at any time t, the signal $y_t$ which is stored back into the wavetable is a function of the result $v_t$ of accumulated modifications of the original contents $x_t$ of the wavetable, and a current modification component $m_t$. Therefore, the signal $y_t$ is a function of $v_t$ and $m_t$ given by the following Eq. (3):

$$y_t = f(v_t, m_t) \quad (3)$$

In a digital sample embodiment, the $n^{th}$ sample of $y_t$ is given as $y_n$. Using the delay operator, $D^N$, to represent a delay of N cycles, $y_n$ is a function of $v_t$, which is given by $D^N y_n$ and the $n^{th}$ modification factor $m_n$ as given in the following Eq. (4):

$$y_n = f(D^N y_n, m_n) \quad (4)$$

In connection with Eq. (4), the maximum number of samples stored, which determines the maximum value of N, can be any number. The greater the number of samples, the lower the frequency components which can be produced. In one example, 256 8-bit samples are stored which allow N to be a maximum of 255. Also, many different types of modification components, $m_n$, can be selected. For simplicity and economy, however, it is desired to have $m_n$ computationally simple. One simple modification component will be described in connection with the generation of a plucked-string musical sound.

Plucked-String Sound

Figure 3:
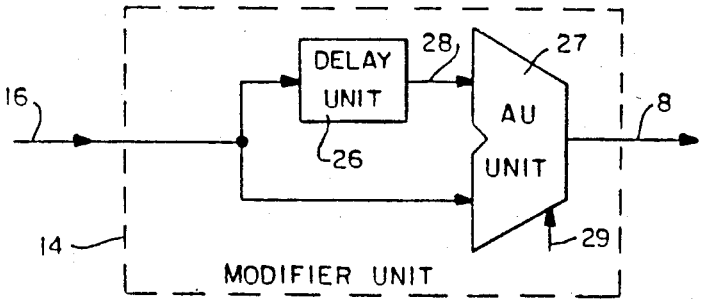
FIG. 3 depicts a schematic electrical block diagram of the modifier unit which forms a portion of the wavetable-modification generator in the FIG. 2 musical instrument.

In FIG. 3 further details of a modifier unit 14 for generating plucked string musical sounds are shown. The unit 14 includes a delay 26 which delays the signal on bus 16, $y_{n-N}$, by one period of n. The output from the delay 26 forms one input, $y_{n-(N+1)}$, on line 28 to an arithmetic unit (AU) 27. The other input to the arithmetic unit 27 is derived directly from the bus 16. The arithmetic unit 27 adds the value on bus 16 to the previous value on bus 16 (which is the output from delay 26) and forms their sum. The shift input 29 to the arithmetic unit 27 causes the sum to be shifted one binary bit, thereby dividing the sum by two. The arithmetic unit 27 produces as its output 8 either this sum, or the unmodified input on bus 16, depending on the decay probability d and a random number $r_n$.

With the modifier unit of FIG. 3 connected in the wavetable-modification generator 3 of FIG. 2, a plucked string sound will be generated. The wavetable-modification generator 3 in FIG. 2 formed using the modifier unit 14 of FIG. 3 is analogous, in some ways, to a digital filter. The digital filter in the form of generator 3 simulates the string of a mechanically vibrating stringed instrument. A short input signal to the digital filter represents the "pluck" of the "string" and excites the generator 3 to generate the desired output signal during a subsequent decay period. For simplicity in the subsequent analysis, it will be temporarily assumed that the decay probability d=1, and that the pluck duration M, is equal to the pitch number N. The output signal from the modifier unit 14 as it appears on line 8 in FIG. 2 is then given as follows for n greater than or equal to 0:

$$y_n=x_n+[y_{n-N}+y_{n-(N+1)}]/2 \tag{5}$$

where $x_n$ is the input signal amplitude at sample n, $y_n$ is the output amplitude at sample n, and N is the desired pitch period (approximately) of the note in samples. For n less than 0, $y_n$ is defined to be 0.

The basic plucked string sound is obtained by exciting the generator 3, for example, with a short burst of "white noise". A burst of white noise is obtained by selecting the values of $x_n$ in Eq. (5) as follows:

$$x_n=Au_n, \quad \text{when } n=0,1,2,\ldots,(N-1) \tag{$6_1$}$$

$$x_n=0, \quad \text{when } n\geqq N, \tag{$6_2$}$$

where A is the desired amplitude, and $u_n$ has values +1 or −1 as a function of the output of a random number generator. The values of $x_n$ for n equal to 0, 1, . . . , (N−1) are stored in wavetable 13 as initial values existing prior to any modification by modifier unit 14.

Finally, the output $y_n$ is utilized by the output device 4 in FIG. 2 to generate the sound.

The use of a random noise burst rather than a predetermined waveform during the pluck adds materially to the realism of the sound produced. This is especially apparent when the same pitch is rapidly repeated (guitarist's "tremolo") since the individual notes each have a unique timbre due to their different initializations.

Analysis of the Plucked String Sound

The input-output relation of Eq. (5) can be expressed differently by means of "delay operator" notation. We define the unit-sample delay operator, D, by the relation, $$D^k x_n=x_{n-k} \tag{7}$$

where $x_n$ is an arbitrary signal, and k is an integer. Multiplying a signal by $D^k$ delays the signal in time by k samples. In these terms Eq. (5) becomes, $$\begin{aligned} y_n &= x_n + [D^N y_n + D^{N+1} y_n]/2 \\ &= x_n + D^N[(1+D)/2]y_n. \end{aligned} \tag{8}$$

Solving Eq. (8) for the output signal $y_n$ yields, $$y_n=x_n/[1-[(1+D)/2]D^N]. \tag{9}$$

Linear delay-operator equations convert immediately to z-transform equations by replacing each time signal by its z-transform, and replacing D by $z^{-1}$. Time signals such as $x_n$ or $y_n$ are denoted in lower case letters and the corresponding z-transforms are denoted in upper case letters, for example X(z) or Y(z).

The transfer function of a (linear time-invariant) digital filter is the z-transform of the input. The transfer function of the plucked string simulator of FIG. 2 is found therefore by substituting $z^{-1}$ for D in Eq. (9) and transposing as follows:

$$\begin{aligned} H(z) &= Y(z)/X(z) = 1/[1-[(1+z^{-1})/2]z^{-N}] \\ &= 1/[1-[H_a(z)][H_b(z)]]. \end{aligned} \tag{10}$$

where, $$H_a(z)=(1+z^{-1})/2$$

$$H_b(z)=z^{-N}.$$

Eqs. (9) and (10) describe one embodiment of the wavetable-modification generator 3 of FIG. 2. The feedback loop consists of a length N delay line $H_b(z)$, implemented as wavetable 13, in series with a two-point average $H_a(z)$, implemented as modifier unit 14. The input to wavetable 13 is at terminal 20 and the output from modifier unit 14 is at terminal 21. Terminal 21 is connected to terminal 20 in a feedback relation which forms a closed loop.

The frequency response of the FIG. 3 generator is defined as the transfer function evaluated at $z=e^{j\omega T}=\cos(\omega T)+j\sin(\omega T)$ where T is the sampling period in seconds (T is the inverse of the sampling rate $f_s$), $\omega=2\pi f$ is radian frequency, f is frequency in Hz, and $j=\sqrt{-1}$.

The frequency response of the plucked string instrument of FIG. 2 is given as follows:

$$H(e^{j\omega T})=1/[1-H_a(e^{j\omega T})H_b(e^{j\omega T})] \tag{11}$$

where, $$\begin{aligned} H_a(e^{j\omega T}) &= [1+e^{-j\omega T}]/2 = e^{-j\omega T/2}\cos(\omega T/2) \\ &= e^{-\pi fT}\cos(\pi fT) \end{aligned} \tag{12}$$

$$H_b(e^{j\omega T}) = e^{-j\omega NT} = e^{-j2\pi fNT}. \tag{13}$$

The frequency response peaks at certain frequencies which correspond to the fundamental and overtones (partials) of the tone produced. These frequencies can be determined from the location of the poles of the transfer function H(z) (those values of z where $H_a(z)H_b(z)=1$) which corresponds to finding the complex roots of the polynomial of degree (N+1). Since in general it is not algebraically possible to find these roots analytically for large N, approximation methods must be used.

It is useful to consider the amplitude response and phase delay of the wavetable component, $H_b$, and the modifier component $H_a$, separately. The amplitude response is defined as the magnitude of the frequency response, and it gives the gain as a function of frequency. The phase delay is defined as minus the complex angle of the frequency response divided by radian frequency, and it gives the time delay (in seconds) experienced by a sinusoid at each frequency.

The amplitude response $G_a$ and $G_b$ of each component $H_a$ and $H_b$, respectively, is given as follows:

$$G_a(f)=|H_a(e^{j\omega T})|=|\cos(\omega T/2)|=|\cos(\pi fT)| \quad (14)$$

$$G_b(f)=|H_b(e^{j\omega T})|=1 \quad (15)$$

Thus, the delay line component $H_b$ is lossless, and the two-point average $H_a$ exhibits a gain which decreases with frequency according to the first quadrant of a cosine. All frequencies are restricted to the Nyquist limit, that is, $|f|\leqq f_s/2$. In this range, we have $|\cos(\pi fT)|=\cos(\pi fT)$.

It is more convenient to define phase delay in units of samples rather than seconds. The phase delays of $H_a$ and $H_b$ in samples are given as follows:

$$P_a(f)=-[\angle H_a(e^{j\omega T})]/\omega T=\tfrac{1}{2}, \quad (16)$$

$$P_b(f)=-[\angle H_b(e^{j\omega T})]/\omega T=N. \quad (17)$$

where, "$\angle$" denotes the complex angle of z.

The two-point average $H_a(z)$ has a phase delay equal to one-half a sample, $\frac{1}{2}$, and the delay line has a phase delay equal to its length, N. Since the total loop consists of $H_a$ (modifier unit 14) and $H_b$ (wavetable 13) in series, we have a loop gain given as follows:

$$\text{Loop Gain}=G_a(f)G_b(f)=\cos(\pi fT), \quad (18)$$

and the effective loop length is given as follows:

$$\text{Loop Length}=P_a(f)=P_b(f)=N+\tfrac{1}{2}\ \text{(samples)} \quad (19)$$

for each sinusoidal frequency f Hz.

In synthesizing a single plucked string note, N samples of white noise at amplitude A are supplied by the wavetable 13 and the output sound occurs immediately after the first N samples. The delay line $H_b$ represented by wavetable 13 is essentially filled with scaled random numbers at time 0 and need employ no other input signal. Since the two-point average $H_a$ from modifier unit 14 is constantly changing, the contents of the loop and the output signal $Y_n$ are not periodic. However, the output signal is close to periodic and, therefore, the term "period" in this application is intended to mean nearly periodic or quasi-periodic. Each "period" of the synthetic string sound corresponds to the contents of the delay line (wavetable 13) at a particular time, and each period equals a mildly low-passed version of the previous period. More precisely, a running two-point average of the samples offset by one period gives the next period in the output waveform. Since the effective loop length is $N+\frac{1}{2}$ samples, the period is best defined to be $NT+T/2$ seconds where T is the sampling period and is equal to $1/f_s$ where $f_s$ is the sampling frequency. Experience shows that the quantity $NT+T/2$ corresponds well with perceived pitch period.

Numerical computation of the location of the poles of H(z) shows the above approximation to be very good for large values of N. An even more accurate estimate is obtained by multiplying the expression for the fundamental period given above by the correction factor $N^4/(N^4-1)$, but it can be seen that this correction is significant only for very small values of N. More important is the fact that the fundamental period is not an exact integer (in fact it is not even exactly half-integral, although extremely close). Thus a digital representation of exactly one period of the fundamental tone is not, and cannot, be stored in the waveform memory by the very nature of the modification done. Only in the special case of no modification (decay probability d=0) is the period an exact integer, but in that case the waveform is not evolving with time and is musically unsatisfactory.

Decay of Harmonics

Since the output signal $Y_n$ is quasi-periodic, the output signal does not consist of discrete sinusoids. Essentially the output signal has many narrow bands of energy decaying to zero at different rates. When these energy bands are centered at frequencies which are an integer multiple of a lowest frequency, they will be referred to as "harmonics". When the frequency components are not necessarily uniformly spaced, the term "partial" will be used to emphasize the possibility of inharmonicity.

Consider a partial at frequency f Hz circulating in the loop. On each pass through the loop, the partial suffers an attenuation equal to the loop amplitude response, $G_a(f)G_b(f)$ equal to $\cos(\pi fT)$, that is, $$\text{One Period's Attenuation}=\cos(\pi fT).$$

Since the round-trip time in the loop equals $N+\frac{1}{2}$ samples, the number of trips through the loop after n samples (nT seconds) is equal to $n/(N+\frac{1}{2})=tf_s/(N+\frac{1}{2})$. Thus the "attenuation factor", $a_f(t)$, at time t=nT is given as follows:

$$a_f(t)=[\cos(\pi fT)][tf_s/(N+\tfrac{1}{2})]. \quad (20)$$

For example, an initial partial amplitude A at time 0 becomes amplitude $Aa_f(t)$ at time t seconds, where f is the frequency of the partial.

The "time constant", $c_f$, of an exponential decay is traditionally defined as the time when the amplitude has decayed to 1/e, that is, to approximately 0.37 times its initial value. The time constant at frequency f is found by equating Eq. (20) to $e^{-t/(cf)}$ and solving for $c_f$ as follows (note that $f_s=1/T$):

$$c_f=-t/[\ln a_f(t)] \quad (21)$$

$$=-[(N+\tfrac{1}{2})T]/[\ln\cos(\pi fT)]\ \text{(seconds)}$$

For audio, it is normally more useful to define the time constant of decay as the time it takes to decay −60 dB or to 0.001 times the initial value. In this case, we equate Eq. (20) to 0.001 and solve for t. This value of t is often called $t_{60}$. Conversion from $c_f$ to $t_{60}(f)$ is accomplished in the following manner:

$$t_{60}(f)=\ln(1000)c_f \quad (22)$$

that is, approximately $6.91c_f$.

For example, if a sinusoid at frequency f Hz has amplitude A at time 0, then at time $t_{60}(f)$ it has amplitude $Aa_f(t_{60}(f))=A/1000$, or it is 60 dB below its starting level.

The above analysis describes the attenuation due to propagation components around the loop. It does not, however, incorporate components which do not "fit" in the loop and which are quickly destroyed by self-interference. This self-interference is analogous to a physical string which is mechanically vibrating. Any excitation may be applied to the string, but after the excitation ceases, the remaining energy quickly assumes a quasi-periodic nature determined primarily by the length of the string.

In a similar manner, even though the loop in the FIG. 2 instrument is initialized with random numbers, after a very short time the primary frequencies present in the loop will be those which have an integral number of periods in $N+\frac{1}{2}$ samples. These frequencies are all multiples of the lowest frequency, called the fundamental frequency, whose period exactly matches the loop length $N+\frac{1}{2}$. This lowest frequency, $f_1$, provides the pitch frequency of the note and is given as follows:

$$f_1=1/[(N+\tfrac{1}{2})T]=f_s/(N+\tfrac{1}{2}). \quad (23)$$

where, $f_s$=sampling frequency $T=1/f_s$=sampling period

Setting f to the harmonic series beginning with $f_1$ as follows, $$f_k=\omega_k/2\pi=k[f_s/(N+\tfrac{1}{2})], \quad (24)$$

where, k=1,2, . . . N/2, gives the decay factor at time t for the $k^{th}$ harmonic as follows:

$$a_k(t)=[\cos(\pi f_k T)]^{f_1 t}. \quad (25)$$

Similarly, the time constant per harmonic is given in seconds as follows:

$$c_k = -t/[\ln a_k(t)] \quad (26)$$

$$= -[1/[f_1 \ln(\cos(\pi f_k T))]]$$

Figure 4:
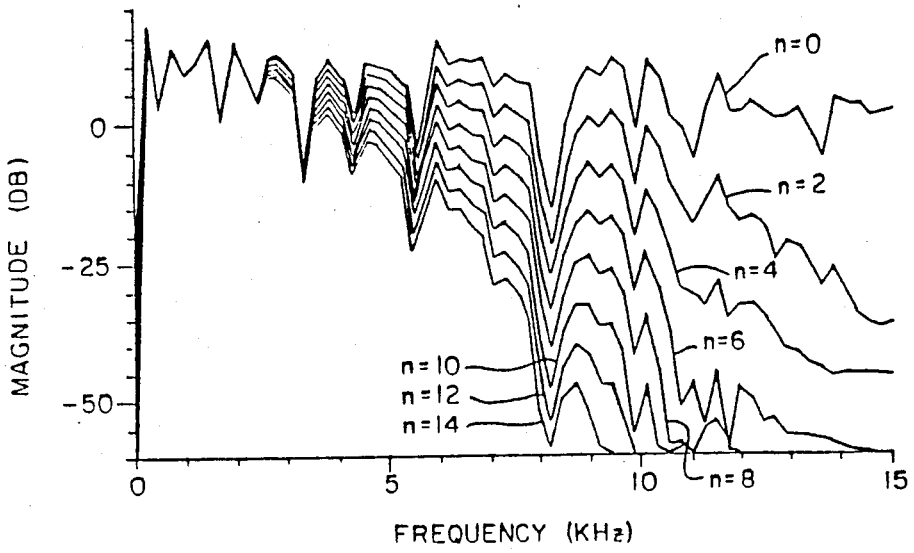
FIG. 4 depicts a graph of the amplitude versus frequency of the output signal during the first fifteen periods for a typical note of musical instrument of the FIG. 2 and FIG. 3 type.

FIG. 4 shows the spectral evolution during the first fifteen periods of a note having a period of 128 samples from an instrument of the FIGS. 2 and 3 type. A length 128 Fast Fourier transform (FFT) was computed every other period, that is, for n equal to 0, 2, 4, . . . , 14. Note that the higher harmonics decay faster; this mimics the behavior of an actual string, where the higher harmonics dissipate their energy faster.

In certain alternative embodiments, where the modifier unit 14 has $H_a$ considered more generally than a two-point average, the attenuation factor of the $k^{th}$ harmonic after t seconds is given as follows:

$$a_k(t)=G_a(fk)[tf_s/[N+P_a(f_k)]]; \quad (27)$$

where $G_a(f)\leqq 1$ for stability. The phase delay $P_a(f_k)$ is approximately the same at all harmonic frequencies $f_k$.

Similarly, when $H_a$ is considered more generally, the time constant of decay for each harmonic is given in seconds as follows:

$$c_k=-[(N+P_a(f_k))/(f_s \ln G_a(2\pi f_k T))] \quad (28)$$

For simplicity it has been assumed in the above analysis that the decay probability d=1. For other values of d it is necessary to scale (stretch) the above decay time constants ($c_f$, $t_{60}$, and $c_k$) by the factor s=1/d. Also, the term $(N+\frac{1}{2})$ in the expressions for the fundamental frequency and harmonics (Eqs. (23) and (24) above) needs to be replaced by the term (N+d/2). Again, numerical computation of the poles of H(z) alters these estimates slightly, and shows that there is actually a very small amount of inharmonicity present (especially in the higher partials). This inharmonicity adds to the realism of the sound since it avoids exact phase-lock among the harmonics. By way of comparison, note that real physical strings exhibit inharmonicity due to stiffness.

Sixteen Voice Embodiment

Figure 5:
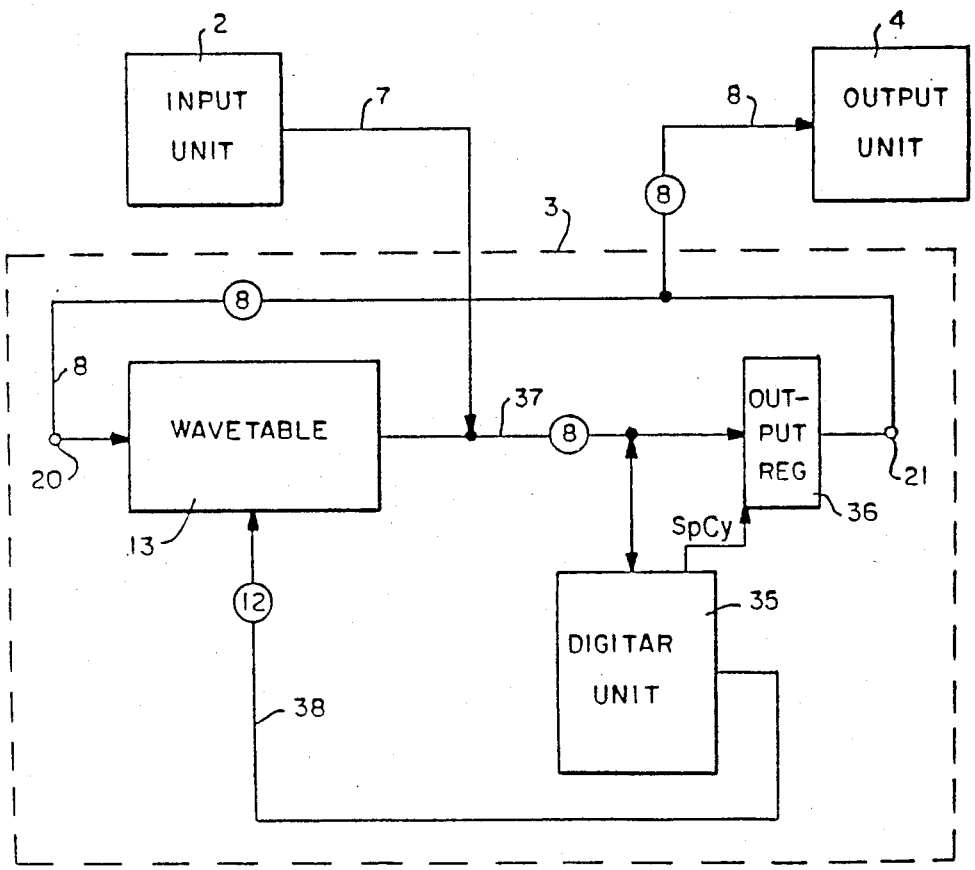
FIG. 5 depicts an electrical block diagram of one embodiment of the present invention which is constructed utilizing a DIGITAR semiconductor chip.

In FIG. 5, a 16-voice embodiment of the FIG. 2 instrument employing a modifier unit of the FIG. 3 type is shown.

In FIG. 5, the wavetable 13 is a random access memory (RAM) having sixteen different storage regions, one for each of sixteen voices. Each of the storage regions has wave-table storage locations for 256 8-bit bytes. Accordingly, the pitch number, N, is a maximum of 255 for any voice. The wavetable-modification generator 3 also includes an 8-bit output register 36 and a DIGITAR unit 35. The DIGITAR unit 35 performs the modifications of the type previously described in connection with the modifier unit of FIG. 3 for all sixteen voices of the FIG. 5 instrument. The DIGITAR unit 35 has a 12-bit address bus 38 connected to address the wavetable 13. Additionally, the unit 35 connects to the 8-bit data bus 37. Data bus 37 also connects the wavetable 13 to the output register 36. Input unit 2 is connected by bus 7 to the common data bus 37. The output register 36 connects by 8-bit bus 8 as an input to the output unit 4 and as a data input to the wavetable 13.

Figure 6:
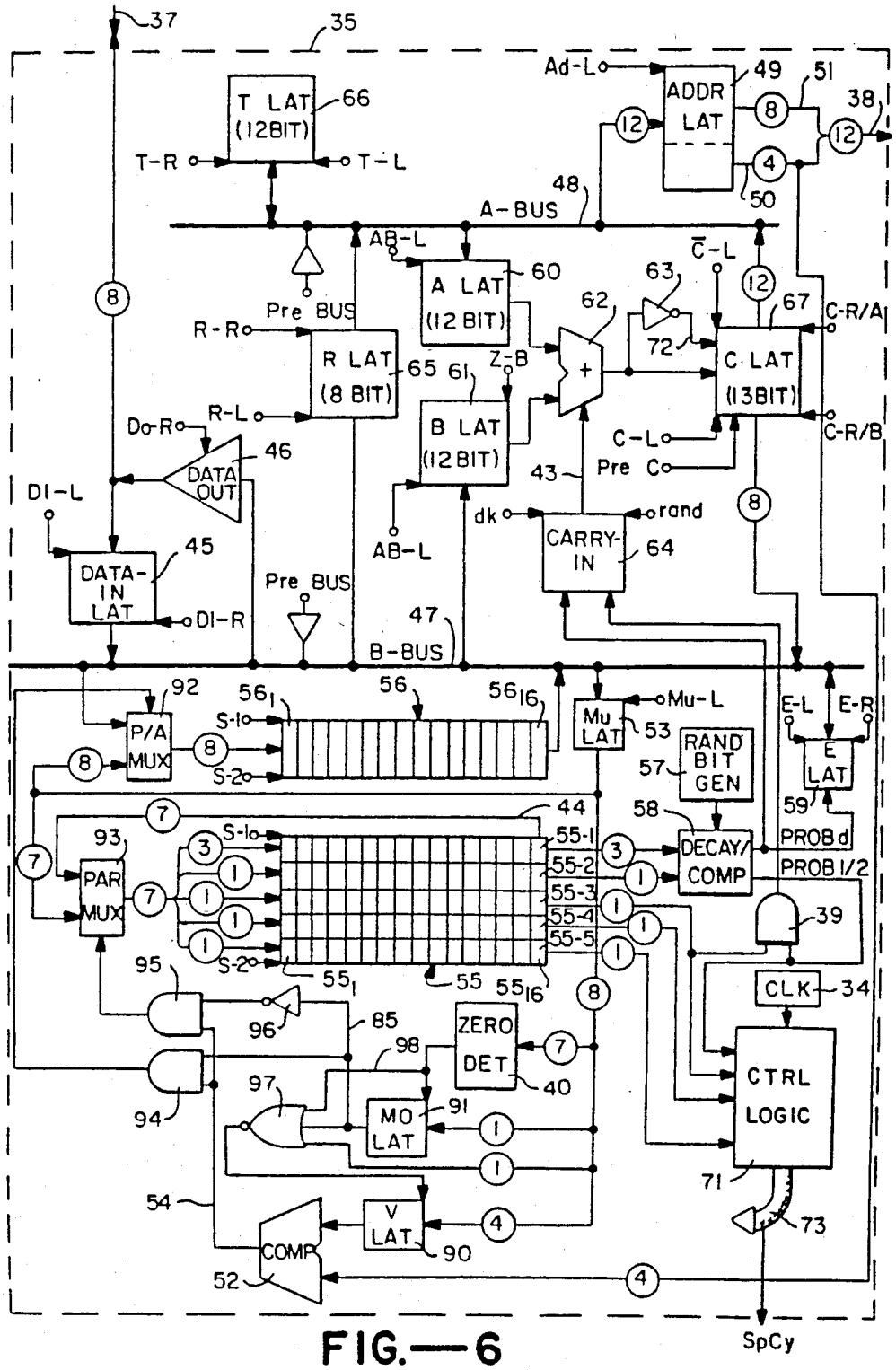
FIG. 6 depicts a schematic electrical block diagram of the DIGITAR chip employed in the FIG. 5 musical instrument.

Further details of the DIGITAR unit 35 of FIG. 5 are shown in FIG. 6.

In FIG. 6, the data bus 37 connects as an input to the data-in latch 45 and receives an output from the tristate gates 46. The data-in latch 45 and the tri-state gates 46 connect to the common data bus 47 which is identified as the B bus. Data is input to and output from the DIGITAR unit of FIG. 6 over the B bus 47 and data bus 8.

In FIG. 6, an A bus 48 is utilized to carry the address to an address register 49. Address register 49 connects its output to a 12-bit address bus 38 which provides addresses to the wavetable 13 in FIG. 5. The four low-order output bits on bus 50, from the address register 49, are encoded to specify one of the 16 voices. The bus 50 also connects as an input to the voice-match comparator 52.

In FIG. 6, the Mu latch 53 receives data from the Bus 47 when the latch signal Mu-L is asserted. The bit locations in latch 53 are designated c0, c1, . . . , c7. The 8-bit output from the latch 53 connects to a number of inputs. The high-order bits c1, . . . , c7 connect as an input to the zero detector 40. Zero detector 40 detects when all of the bits c1, . . . , c7 are 0's and responsively asserts an output on line 98. The output on line 98, when asserted, is a latch signal to the 1-bit mode latch 91. Mode latch 91 receives the c0 bit from latch 53. When the c0 bit latched into latch 91 is a logical 0, it indicates that the parameter mode has been selected. When the bit in latch 91 is a logical 1, it indicates that the pitch/amplitude mode has been selected. The output from latch 91 connects as an input to NOR gate 97. Gate 97 receives its other inputs from the zero detector 40 and the c4 bit from latch 53. When zero detector 40 senses with a non-asserted output that all of the bits c1, . . . , c7 are not logical 0 and latch 91 stores a 0 to indicate that the parameter mode is called for, gate 97 is satisfied when c4 is zero to provide a latch signal to the voice latch 90. Voice latch 90, in response to the latch signal from gate 97, stores the bits c0, . . . , c3 from the Mu latch 53. In this manner, a new voice is selected to allow different parameters for that voice to be changed. The output from the voice latch 90 connects as the other input to the voice-match comparator 52. When the voice identified in the voice latch 90 corresponds to the voice being addressed by the address latch 49, the output from comparator 52 is asserted on line 54.

In FIG. 6, the output line 54 from the voice-match comparator 52 connects as enable inputs to the AND gates 94 and 95. Gates 94 and 95 are, therefore, enabled whenever the voice identified in latch 90 is the same as the voice being addressed by the address latch 49.

The other input to AND gate 94 is the output from the mode latch 91 on line 85. Gate 94 will be satisfied, therefore, whenever the voice match occurs and the mode latch 91 indicates that the unit is in the pitch/amplitude mode. AND gate 94 controls the operation of the multiplexer 92.

Multiplexer 92 receives one data input from the Mu latch 53 and the other input from the Bus 47. When gate 94 is satisfied, the multiplexer 92 selects the lower input from the latch 53 and loads a new pitch or amplitude value into the Pbot stage $56_1$ of the shift register 56. When gate 94 is not satisfied, multiplexer 92 selects the data on the B bus which is derived from the Ptop stage $56_{16}$ of the shift register 56.

In a similar manner, the AND gate 95 is satisfied when the mode latch 91 is in the parameter mode. When satisfied, gate 95 controls the parameter multiplexer 93 to select the lower input to load new parameter values from the Mu latch 53 into the Pbot stage 55-1 of the shift register 55. When gate 95 is not satisfied, multiplexer 93 selects via bus 44 the Ptop data from stage $55_{16}$ to be reinserted into the Pbot stage $55_1$.

In the manner described, in response to commands in the latch 53, new pitches or amplitudes can be inserted into the corresponding voice location in the shift register 56 or new parameters can be inserted into the corresponding voice location in the shift register 55.

In FIG. 6, the arithmetic unit 62 is a conventional 12-bit device which, among other things, adds 12-bit data received on each of its two input ports. Unit 62 is partitioned into an 8-bit high-order portion and a 4-bit low-order portion. The carry-out from the low-order portion is OR'ed with the line 43 signal to form the carry-in to the high-order portion. A carry-in 1 on line 43 is used to add +1 to the high-order 8-bit portion under control of the carry-in unit 64 when the low-order four bits in latch 61 have been cleared to 0 by the Z-B signal. One of the input ports for the arithmetic unit 62 is fed from the 12-bit A latch 60 and the other input port is fed from the 12-bit B latch 61. The A latch 60 derives its input from the A bus 48 and the B latch derives its input from the B bus 47. An 8-bit R latch 65 connects data from the high-order 8 bits of the B bus 47 to the corresponding high-order 8 bits of the A bus 48. A 12-bit T latch 66 connects to and from the A bus 48 for use as a register for storing the current Write Pointer address. The 13-bit output from the arithmetic unit 62 connects to a 13-bit C latch 67 either directly or after inversion in inverter 63. The C latch 67 connects the low-order twelve bits of its output to the A bus 48 when the C-R/A signal is asserted and connects the high-order eight bits directly to the B bus 47 when the C-R/B signal is asserted. Selecting the high-order eight bits from the 13-bit latch 67 effectively shifts by 1-bit, that is, divides by 2 any 8-bit number in the C latch 67.

In FIG. 6, the random bit generator 57 is a standard feedback shift register type with 18 stages. A new random bit is produced for each sample for each voice. The seven most recently produced bits are also available at any time. Provision is made for forcing the generator out of the forbidden state (all zeroes) characteristic of generators of this type.

In FIG. 6, the decay compute unit 58 is a selector for selecting different probability values "d" from the random bit generator 57 as a function of the rate specified by bits c0, c1, c2 from field 55-1 and by the coherence bit c3 from field 55-2 of the Ptop stage $55_{16}$. The outputs from unit 58 are the PROBd and the "PROB½" lines.

The output on the PROB½ line is a logical 1 one-half of the time and a logical 0 the other half of the time except when the coherence bit c3 is asserted, in which case the output on the PROB½ line is the same in a current cycle as it was in the previous cycle. The PROB½ line is one input to the control logic 71 and also is an input to the AND gate 39. The gate 39 derives its other input from the c7 bit, the dither bit, from the output field 55-3 of the stage $55_{16}$. The output from gate 39 forms one of the control inputs to the carry-in unit 64.

The PROBd line output from the unit 58 has either a 1 or a 0 state where the probability of being a 1 is controlled as a function of the 3-bit output from the field 55-1, command bits c0, c1, c2. These three command bits are encoded as the negative of the binary logarithm of the desired probability, and are used to specify how many (from 0 to 7) recently produced bits from the random bit generator 57 to test for an all-zero condition. If all such examined random bits are zero, then the PROBd line is set to a logical 1, otherwise to a logical 0. As an exception, if the three command bits are all ones, this test is bypassed, and PROBd is forced to a logical 0 state. In this manner, the PROBd line has 1 or 0 logical states with the relative probability selectable as one of the eight values, namely, 1, 1/2, 1/4, 1/8, 1/16, 1/32, 1/64, and 0. The PROBd line connects as one input to the carry-in unit 64 and as another input to the E latch 59. The input to the E latch 59 selects either the true or complement value of the quantity stored in the E latch to be gated out onto the B bus 47 as a function of the 1 or 0 state, respectively, of the PROBd line.

In FIG. 6, the PROBd line connects as the other input to the carry-in unit 64. The carry-in unit 64 is a selector unit for selecting either the PROBd line or the output from the AND gate 39 as the signal to control the carry-in line 43. When the "dk" line from control logic 71 is asserted, the gate 39 line is selected. When the control line rand is asserted from control logic 71, then the PROBd line from the unit 58 is selected.

The effect of selecting the PROBd line during the decay operation is to permit probabilistic decay stretching to occur. Under the operation with no decay stretching, the carry-in from the unit 64 on line 43 adds a +1 value to the Read Pointer address to allow the Read Pointer +1 address to be calculated. For decay stretching, however, the addition of +1 is inhibited some number of times so that the Read Pointer address is used twice rather than using the Read Pointer +1 address. Under these conditions, there is no modification to the data value read from the Read Pointer address, and the same data value is placed back into the Write Pointer address. The greater the frequency with which the +1 addition is inhibited, the longer the stretching. The PROBd line also is used during the pluck operation to select different initial values of amplitude.

Since the PROBd line is computed from up to seven serially produced bits from the random bit generator, there is some correlation between successive values of PROBd. However, this correlation is not important since successive values are used for different voices. By the time return is made to a given voice, a total of 16 random bits have been produced, thus eliminating any correlation for successive samples of that voice. The required computational complexity is thereby reduced by allowing a simple random bit generator to be used instead of a more complex full random word generator.

DIGITAR Control

The control of the DIGITAR unit of FIG. 6 is carried out by control (CTRL) logic 71. Control logic 71 continuously cycles through seven control cycles where each cycle has a first phase and a second phase. The control cycles are designated as $1_1$, $1_2$; $2_1$, $2_2$; . . . ; $7_1$, $7_2$. All of the cycles $1_1$, . . . , $7_2$ are collectively referred to as one logic-array cycle or simply as a logic cycle.

A number of control lines 73 are output from the control logic 71 and connect throughout the FIG. 6 unit and in some cases to the FIG. 5 instrument.

The control lines 73 form the control logic 71 and their functions are indicated in the following TABLE I.

TABLE I

| LINE | FUNCTION |
|---|---|
| E-L | Latch B Bus Data into E Latch 59 |
| Mu-L | Latch B Bus Data into Mu Latch 53 |
| DI-R | Gate Data from DI Latch 45 onto B Bus 47 |
| E-R | Gate Data from E Latch 59 to A Bus 48 if P is 1 |
| T-L | Latch A Bus Data into T Latch 66 |
| T-R | Gate Data from T Latch 60 to A Bus 48 |
| rand | Carry-in Bit 4 Selected from Random Bit Generator 57 |
| dk | Carry-in Bit 4 Selected from Gate 39 |
| PreBus | A and B Busses Charged to "1" |
| R-L | Latch Bus B Data into R Latch 65 |
| R-R | Gate Data from R Latch 65 to A Bus |
| Z-B | Zero Low-Order 4 Bits of B Latch 61 |
| AB-L | Latch Data into A and B Latches from Busses A and B |
| PreC | Clear C Latch 67 Charged to 1's Complement |
| C-L | Latch Data from Line 69 into C Latch 67 Unless $\overline{\text{C-L}}$ is 1 |
| $\overline{\text{C-L}}$ | Latch Data from Line 72 into C Latch 67 Unless R is 1 |
| C-R/A | Gate Data from C Latch 67 to A Bus 48 |
| C-R/B | Gate Data from C Latch 67 to B Bus 47 if $\overline{\text{P}}$ is 1 |
| Ad-L | Latch Data from A Bus into Addr Latch 49 |
| SpCy | Special Cycle Latches Output Register 36 |
| DO-R | Gate Data on B Bus through Gates 46 to Data Bus 8 |
| DI-L | Latch Bus 8 Data into DI Latch 45 |
| S-1 | Internal Shift of Registers 55 and 56 does not Affect Ptop nor Voice Number Stored |
| S-2 | Shift of Registers 55 and 56, Changes Ptop and Changes Random Bit |

In TABLE I, the postscript L for each of the signal lines indicates that a latching function into a latch occurs. A postscript R indicated that a read (gate out) function from the latch circuit occurs.

The following TABLE II depicts the binary and other states of each of the lines identified in TABLE I for each phase of the seven control cycles produced by control logic 71 of FIG. 6.

The P and $\overline{\text{P}}$ signals for the lines E-R and C-R/B, respectively, are determined by the c5 and c6 bits from stages 55-5 and 55-4 of register stage $55_{16}$. If bits c5 and c6 are both 1's, then P is 1 and $\overline{\text{P}}$ is 0. When P is 1, it indicates the plucking period for selecting the amplitude from the E latch 59 to the B bus 47. When $\overline{\text{P}}$ is 1, the output data is selected from the C latch 67 to the B bus 47. The $\overline{\text{L}}$ signal for line C-L is the 1 or 0 state of the line $\overline{\text{C}}$-L. The R signal in the line $\overline{\text{C}}$-L is a 1 in the harp mode, that is, local parameter bit c4 is 0 and c5 is 1. In the drum mode (c5 and c6 both 0), R is the "PROB½" signal from unit 58. The D signal in the "rand" line is the complement of c7 (the dither bit). In the Z-B line, the ∅ symbol indicates that either a 0 or 1 can be present.

TABLE II

| Line | $1_1$ | $1_2$ | $2_1$ | $2_2$ | $3_1$ | $3_2$ | $4_1$ | $4_2$ | $5_1$ | $5_2$ | $6_1$ | $6_2$ | $7_1$ | $7_2$ |
|---|---|---|---|---|---|---|---|---|---|---|---|---|---|---|
| E-L | 1 | 0 | 0 | 0 | 0 | 0 | 1 | 0 | 0 | 0 | 0 | 0 | 0 | 0 |
| Mu-L | 1 | 0 | 0 | 0 | 0 | 0 | 0 | 0 | 0 | 0 | 0 | 0 | 0 | 0 |
| DI-R | 0 | 0 | 0 | 0 | 1 | 0 | 0 | 0 | 1 | 0 | 0 | 0 | 0 | 0 |
| E-R | 0 | 0 | 0 | 0 | 0 | 0 | 0 | 0 | 0 | 0 | 0 | 0 | P | 0 |
| T-L | 1 | 0 | 0 | 0 | 0 | 0 | 0 | 0 | 0 | 0 | 0 | 0 | 0 | 0 |
| T-R | 0 | 0 | 0 | 0 | 0 | 0 | 0 | 0 | 0 | 0 | 1 | 0 | 0 | 0 |
| rand | 0 | 0 | 0 | 0 | 0 | 0 | 0 | 0 | 0 | D | 0 | 0 | 0 | 0 |
| dk | 0 | 0 | 0 | 0 | 0 | 1 | 0 | 0 | 0 | 0 | 0 | 0 | 0 | 0 |
| PreBus | 0 | 1 | 0 | 1 | 0 | 1 | 0 | 1 | 0 | 1 | 0 | 1 | 0 | 1 |
| R-L | 0 | 0 | 0 | 0 | 1 | 0 | 0 | 0 | 0 | 0 | 0 | 0 | 0 | 0 |
| R-R | 0 | 0 | 0 | 0 | 0 | 0 | 0 | 0 | 1 | 0 | 0 | 0 | 0 | 0 |
| Z-B | 1 | 0 | ∅ | 0 | 1 | 0 | ∅ | 0 | 1 | 0 | ∅ | 0 | 0 | 0 |
| AB-L | 1 | 0 | 0 | 0 | 0 | 0 | 0 | 0 | 1 | 0 | 1 | 0 | 0 | 0 |
| PreC | 1 | 0 | 1 | 0 | 1 | 0 | 1 | 0 | 1 | 0 | 1 | 0 | 1 | 0 |
| $\overline{\text{C}}$-L | 0 | 1 | 0 | 0 | 0 | 1 | 0 | 0 | 0 | L | 0 | 0 | 0 | 1 |
| C-L | 0 | 0 | 0 | 0 | 0 | 0 | 0 | 0 | 0 | R | 0 | 0 | 0 | 0 |
| C-R/A | 1 | 0 | 1 | 0 | 0 | 0 | 1 | 0 | 0 | 0 | 0 | 0 | 1 | 0 |
| C-R/B | 0 | 0 | 0 | 0 | 0 | 0 | 0 | 0 | 0 | 0 | 0 | 0 | P | 0 |
| Ad-L | 0 | 0 | 1 | 0 | 0 | 0 | 1 | 0 | 0 | 0 | 1 | 0 | 0 | 0 |
| SpCy | 0 | 0 | 0 | 0 | 0 | 0 | 0 | 0 | 0 | 0 | 0 | 0 | 1 | 1 |
| DO-R | 1 | 0 | 1 | 0 | 1 | 0 | 1 | 0 | 1 | 0 | 1 | 0 | 1 | 0 |
| DI-L | 0 | 1 | 0 | 1 | 0 | 1 | 0 | 1 | 0 | 1 | 0 | 1 | 0 | 1 |
| S-1 | 0 | 0 | 1 | 1 | 0 | 0 | 0 | 0 | 0 | 0 | 0 | 0 | 0 | 0 |
| S-2 | 0 | 0 | 0 | 0 | 0 | 0 | 0 | 0 | 0 | 0 | 1 | 1 | 0 | 0 |

Command Control

The operation of the DIGITAR unit of FIG. 6 is under control of commands. Each command has 8 bits which are designated from high-order to low-order as c7, c6, . . . , c0. There are two modes for interpreting commands, the parameter mode and the pitch/amplitude mode. During the parameter mode, parameters useful for the operation of the FIG. 6 device are loaded from an external source such as input unit 2. During the pitch/amplitude mode, pitches or amplitudes are specified from the external source.

During the phase $1_1$ of each logic cycle, the data from the data-in latch 45 is stored into the Mu latch 53. During phase $1_1$, the mode of the cycle is detected and stored in mode latch 91 of FIG. 6 for determining the Pbot data entry locations of the control shift-registers 55 and 56.

To enter the parameter mode, the command bits on bus 7 are all 0's. To enter the pitch/amplitude (p/a) mode, on bus 7, the command bits c7, c6, c5, c4, c3, c2, c1 are all 0's and the command bit c0 is 1.

Parameter Mode

When in the parameter mode (mode latch 91 set to 0), there are two types of parameters, global parameters which are defined when the command bit c4 is 0 and local parameters when c4 is 1. In order to describe the commands, it is useful to group them in terms of the high-order nybble including the four high-order bits c7, c6, c5, c4 and the low-order nybble including the four low-order bits c3, c2, c1 and c0. The four high-order bits and the four low-order bits can each have their 1 and 0 binary states represented by a hexadecimal character. For example, when the four high-order bits are 0, the hexadecimal character $0_h$ indicates that all bits are 0. When the four low-order bits are 0001, then the hexadecimal character $1_h$ is used to indicate that the bits have these values. In order to indicate that all four bits are all 1's, the hexadecimal character $F_h$ is utilized. Hexadecimal characters are indicated by a subscript "h" representing base 16 binary numbers. That is, each hexadecimal character is expandable to four binary bits.

The command codes for the parameter mode are given by the following TABLE III.

TABLE III

| | BINARY | | | | | | | | |
|---|---|---|---|---|---|---|---|---|---|
| | c7, | c6, | c5, | c4, | c3, | c2, | c1, | c0 | FUNCTION |
| HEX | | | | | | | | | |
| $0_h0_h$ | 0 | 0 | 0 | 0 | 0 | 0 | 0 | 0 | enter par mode |
| $0_h1_h$ | 0 | 0 | 0 | 0 | 0 | 0 | 0 | 1 | enter p/a mode |
| GLOBAL PAR | | | | | | | | | |
| $C_hX_h$ | 1 | 1 | 0 | 0 | X | X | X | X | select voice XXXX |
| $E_hX_h$ | 1 | 1 | 1 | 0 | X | X | X | X | select voice, reset 57 |
| LOCAL PAR | | | | | | | | | |
| $1_hX_h$ | 0 | 0 | 0 | 1 | X | X | X | X | drum (dither) |
| $3_hX_h$ | 0 | 0 | 1 | 1 | | | | | guitar (dither) |
| $5_hX_h$ | 0 | 1 | 0 | 1 | | | | | harp (dither) |
| $7_hX_h$ | 0 | 1 | 1 | 1 | | | | | pluck (dither) |
| $9_hX_h$ | 1 | 0 | 0 | 1 | | | | | drum |
| $B_hX_h$ | 1 | 0 | 1 | 1 | | | | | guitar |
| $D_hX_h$ | 1 | 1 | 0 | 1 | | | | | harp |
| $F_hX_h$ | 1 | 1 | 1 | 1 | | | | | pluck |

| | FUNCTION |
|---|---|
| $X_h0_h$ | Always Decay (Stretch 1) Cohere |
| $X_h1_h$ | Decay Probability 1/2 (Stretch 2) Cohere |
| $X_h2_h$ | Decay Probability 1/4 (Stretch 4) Cohere |
| $X_h3_h$ | Decay Probability 1/8 (Stretch 8) Cohere |
| $X_h4_h$ | Decay Probability 1/16 (Stretch 16) Cohere |
| $X_h5_h$ | Decay Probability 1/32 (Stretch 32) Cohere |
| $X_h6_h$ | Decay Probability 1/64 (Stretch 64) Cohere |
| $X_h7_h$ | Never Decay (Stretch Infinity) Cohere |
| $X_h8_h$ | Always Decay (Stretch 1) Independent |
| $X_h9_h$ | Decay Probability 1/2 (Stretch 2) Independent |
| $X_hA_h$ | Decay Probability 1/4 (Stretch 4) Independent |
| $X_hB_h$ | Decay Probability 1/8 (Stretch 8) Independent |
| $X_hC_h$ | Decay Probability 1/16 (Stretch 16) Independent |
| $X_hD_h$ | Decay Probability 1/32 (Stretch 32) Independent |
| $X_hE_h$ | Decay Probability 1/64 (Stretch 64) Independent |
| $X_hF_h$ | Never Decay (Stretch Infinity) Independent |

The various parameters set forth in TABLE III provide for many different variations in the basic plucked string sound. In the present example, there are three types of plucking instruments which are defined by the high-order nybble. Those instruments are the drum ($1_hX_h$), the quitar ($3_hX_h$) and the harp ($5_hX_h$). In addition to the three types of instruments, the energization, that is, the "pluck" is specified by the local parameter $7_hX_h$. The presence or absence of a modulation bit (called a dither bit) is also controlled by the local parameter high-order nybble. The character $X_h$ in TABLE III indicates that the nybble can have any value.

In TABLE III, the low-order nybbles of the local parameters for the last sixteen entries specify the decay characteristics.

The eight entries in the following TABLE IV show representative examples of parameters specified.

TABLE IV

| HEX | FUNCTION |
|---|---|
| LOCAL PAR | |
| $7_h9_h$ | Symmetric Pluck (i.e. Random Noise) |
| $7_hB_h$ | Asymmetric Pluck (1/8 Inversion) Good for Subsequent Harp Decay |
| $3_h8_h$ | Guitar (Stretch 1) Dither, don't Cohere |
| $9_h9_h$ | Drum (Stretch 2) no Dither or Cohere |
| $D_h8_h$ | Harp (Stretch 1) no Dither or Cohere |
| $7_h8_h$ | "Jam" Constant |
| $D_hF_h$ | Odd Harmonics "Organ" Mode |
| $B_hF_h$ | All Harmonics "Organ" Mode |

In operation, during the local parameter mode, the data value of the command bits c2, c1, c0 are stored in the 3-bit field 55-1 of the shift register 55. The coherence control bit c3 is stored in the 1-bit field 55-2. The control bits c7, c6, and c5 are stored in the 1-bit fields 55-3, 55-4, and 55-5.

When mode latch 91 indicates that a local parameter mode is present and comparator 52 indicates that the voice located in the bottom stage $55_1$ of the shift register 55 is the correct one, then the local parameters are gated from the B bus 47 into the bottom stage $55_1$ of the shift register 55. During each logic array cycle ("logic cycle"), comprising all cycles (both phases) 1 through 7 of TABLE II, the contents of the shift register stages 55 and 56 are shifted one stage. That is, the data in the bottom stages $55_1$ and $56_1$ is shifted to the next adjacent stages $55_2$ and $56_2$ and so on until the data in stages $55_{15}$ and $56_{15}$ is shifted into the top stages $55_{16}$ and $56_{16}$, respectively. The 16 stages $55_0$, $55_1$, . . . , $55_{16}$ and $56_1$, $56_2$, . . . , $56_{16}$ correspond to the 16 different voices of the FIG. 5 and the FIG. 6 instrument.

Many different control parameters can be stored in the shift register 55. The basic operation of the instrument, however, is the same regardless of these parameters as will be described now in connection with the operation during the pitch/amplitude mode.

Pitch/Amplitude Mode

During the pitch/amplitude mode, each sound is constructed from an initial pluck at some amplitude followed by a decay at some specified pitch. In FIG. 6, the sixteen 8-bit stages of the shift register 56 are employed during the "pluck" period to store the maximum amplitude of the pluck and thereafter during the decay period to store the pitch number N.

The pitch/amplitude mode is entered when the $0_h1_h$ code is detected in the Mu latch 53 during the first phase of the seven-cycle logic cycle of TABLE II. If the pitch/amplitude mode is being entered for the first time in connection with a note of a given pitch, then the $0_h1_h$ code will be followed by the amplitude of the pluck sound and that amplitude will be stored in the bottom register stage (Pbot) $56_1$. This amplitude stored in the shift register stage $56_1$ is utilized to fill the wavetable unit 13 of FIG. 5 with appropriate initial values. Either the positive or negative amplitude value is stored at each location in the wavetable for that voice as a function of the 1 or 0 output of random bit generator 57 in FIG. 6.

The manner in which the FIG. 6 circuitry loads the amplitude into the wavetable is as follows. During the first cycle, $1_1$, the next address location is obtained from the C latch 67 and stored in the T latch 66. The amplitude value is accessed from the Ptop stage $56_{16}$ and transferred over the B Bus 47 to the E latch 59.

In cycle 6, the address from the T latch 66 is transferred to the address latch 49 and to the A latch 60. The B latch 61 is loaded with a $-1$ so that in cycle $7_2$, the address in the C latch 67 has been decremented by $-1$. In cycle $7_1$, either the plus or minus amplitude value stored in the E latch 59 is gated through the Data out gates 46 for storage in the memory location of address latch 49. This process is repeated until the wavetable is filled with the plus or minus values of amplitude. While the wavetable is being filled, output data equal to the plus or minus values of the amplitude are supplied to the output unit 4. These values of the amplitude constitute the plucking sound. The plucking sound is present for the duration (M samples) that the wavetable is being filled with the plus and minus amplitude values.

At the appropriate time specified by a command which terminates the plucking phase (thus defining the value of M) and starts the decay phase, the pitch/amplitude mode is again entered and the pitch number, N, is entered into the bottom shift register stage (Pbot) $56_1$. As logic cycles are completed, commands are executed for each one of the sixteen voices.

During the decay portion of the pitch/amplitude mode, the pitch number, N, can be changed for any voice without re-plucking (that is, M=0). This operation produces a musically-useful slur between the old and new pitches. Alternatively, N can be gradually changed, to produce a sliding pitch, or glissando. Normally the decay probability d is constant for the duration of the note; however, it too can be changed in the middle to produce, for example, a note with a fast initial decay and a slow final decay. Such operation is characteristic of a piano sound. During this decay stage, the instrument of FIGS. 5 and 6 continues to perform the operations as set forth in Eq. (5) above in the following manner.

The FIG. 6 unit employs a common Write Pointer for all sixteen voices. The Write Pointer points to the address in the wavetable at which the currently modified data value is to be stored. The Write Pointer is stored in the T latch 66 of FIG. 6. The low-order four bits in the T latch represent the voice field of the address and correspond to the voice field output from address latch 49 on 4-bit bus 50. The high-order 8 bits in the T latch 66 (and correspondingly on bus 51 from address latch 49) represent the write address within the wavetable location for any particular voice. During each logic cycle (the seven cycles of TABLE II), the Write Pointer in latch 66 is decremented by one count.

In operation, a Read Pointer unique for each voice is calculated during each logic cycle by adding the pitch number, N, obtained from the shift register top location $56_{16}$, Ptop, of register 56. The Read Pointer is calculated at a memory address which is N locations behind the Write Pointer. In the particular embodiment of FIG. 6, the addresses in the T latch 66 are decremented once each logic cycle. Therefore, N locations behind the Write Pointer in latch 66 is achieved by adding N to the address in latch 66. If the address in latch 66 were changed by incrementing, then the N would be subtracted from the address in latch 66. The Read Pointer selects data that was stored N cycles previously. That data is modified and stored into the address specified by the Write Pointer.

In the present example, the modification is in accordance with Eq. (5), assuming d=1. The data specified by a "Read Pointer+1" is the data N+1 address away from the address in the T latch 66. The data at the N and the N+1 locations is summed, divided by two and then rewritten into the address specified by the Write Pointer (in the T latch 66).

The normal decay operation carries out the modification part of Eq. (5) in the manner outlined in the following TABLE V when no new commands are being given.

TABLE V

| CYCLE | TO A BUS FROM | FROM A BUS TO | TO B BUS FROM | FROM B BUS TO | TO C |
|---|---|---|---|---|---|
| $1_1$ | C | T,A | Ptop | B | |
| $1_2$ | | | | | Read Pointer |
| $2_1$ | C | Addr | | | |
| $2_2$ | | | | | |
| $3_1$ | | | Din | R | |
| $3_2$ | | | | | Read Pointer + 1 |
| $4_1$ | C | Addr | Ptop | Pbot | |
| $4_2$ | | | | | |
| $5_1$ | R | A | Din | B | |
| $5_2$ | | | | | Sum |
| $6_1$ | T | Addr,A | (−1) | B | |
| $6_2$ | | | | | |
| $7_1$ | | | Sum/2 | Dout | |
| $7_2$ | | | | | T − 1 |

In TABLE V, the last cycle $7_2$, decrements the address in the T register by one. That decremented value is the Write Pointer which is stored in the C latch 67 at the time that a new logic cycle commences at cycle $1_1$. In cycle $1_1$, the Write Pointer is gated from latch 67 to the A bus 48 and from there to the T latch 66 and the A latch 60.

In cycle $1_1$, the pitch number, N, of the current voice (represented by the low-order bits in the T latch 66) appears on the B bus (designated as Ptop in TABLE V), and that value is latched into the B latch 61. In cycle $1_1$, the T value in the A latch 60 and the pitch value N in the B latch 61 are added in the adder 62 to provide the Read Pointer in the C latch 67 at cycle $1_2$.

In cycle $2_1$, the Read Pointer in the C latches is gated over the A bus 48 to the address latch 49 where it is propagated over bus 38 to address the wavetable 13 in FIG. 5. Thus addressed, wavetable 13 provides the data value on bus 8 and it is stored in the data-in latch. In cycle $3_1$, the data-in value in the data-in latch 45 is gated over the B bus 47 and stored in the R latch 65. At cycle $3_2$, the carry-in unit 64 conditionally causes +1 to be added to the contents of the sum of the A and B latches thereby adding +1 to the value in the C latch (when d=1). Since the prior value in the C latch was the Read Pointer (T+N), the new number in the C latch after cycle $3_2$ is the Read Pointer +1 (T+N+1).

In cycle $4_1$, the Read Pointer +1 in the C latch 67 is transferred over the A bus to the address latch 49. From address latch 49, the Read Pointer +1 addresses the wavetable 13 to provide a new data value latched into the data-in latch 45 in cycle $5_1$.

In cycle $5_1$, the data value obtained by the Read Pointer is gated from the R latch 65 to the A latch 60 and the other value of data obtained from the Read Pointer +1 is gated over the B bus 47 to the B latch 61. These two data values are then added by adder 62 to provide the Sum in the C latch 67 in cycle $5_2$.

In cycle $6_1$, the Write Pointer from the T latch 66 is gated over the A bus 48 to the address latch 49 and to the A latch 60.

In cycle $6_1$, the preset value of $-1$ on the B bus is latched into the B latch and thereafter added by adder 62 to the Write Pointer in the A latch to form the new Write Pointer (T−1) which is latched into the C latch in cycle $7_2$. Also, in cycle $6_1$, the Sum from the C latch is gated out from the C latch 67 with a one-bit shift to the B bus 47 and gated out through the tri-state gate 46 to the bus 8 for storage in the wavetable unit 13 at the Write Pointer (T) address. At this point in time, two successive values of data at the Read Pointer and the Read Pointer +1 addresses have been fetched, added and averaged all in accordance with Eq. (5) previously described. Also at cycle $7_2$, the decremented value (T−1) of the Write Pointer has been formed and stored into the C latch 67.

The new value of the Write Pointer defines a different voice since the low-order four bits have been changed. Similarly, the shift register 56 has been stepped one stage so that the pitch number N previously in the Ptop location $56_{16}$ has been circulated over the B bus back into the Pbot location $56_1$.

A new value of the pitch number, N, for a different voice is now stored in the Ptop location $56_{16}$. That new value of N is again used to form the Read Pointer by execution of a complete logic cycle of TABLE V type. This calculation for each of the sixteen voices is performed by sixteen different executions of the logic cycle of the TABLE V type. After the sixteen executions of the TABLE V logic cycle, the T latch 66 continues to be decremented. When decremented, the carryout after the sixteenth decremation carries to the higher order 8-bits within the T latch 66 so that a new location within the wavetable is accessed for each voice. In this manner, all of the locations within the wavetable unit 13 for each of the sixteen voices are accessed in a manner which, for each voice, performs the calculations previously described in connection with Eq. (5).

The transfer of a sample to the output unit 4 of FIG. 5 occurs once at the end of the TABLE V cycle, in cycle $7_1$. After sixteen executions of the TABLE V logic cycle, sixteen samples, one for each voice, have been output to the output unit 4. Thereafter, with sixteen more executions of the TABLE V logic cycle, sixteen additional samples, one for each voice, are output to the output unit 4. It should be noted that the outputs to the output unit 4 are not added but are merely time multiplexed, one at a time for each voice. Each sample is converted in the digital/analog converter 9 to an analog signal which is lowpass filtered in filter 10. The signal on line 18 represents the sound from all sixteen voices as if the outputs on bus 8 had been added prior to the conversion in the digital/analog converter 9. The time multiplexing through a digital-/analog converter followed by lowpass filtering is the equivalent of first adding and thereafter digital/analog converting. This technique further reduces the computational complexity required.

The output signal on bus 8 occurs at a sampling frequency of approximately 20 KHz for each voice. Since all sixteen voices provide an output in a cyclic manner, a new signal appears on the data bus 8 sixteen times as fast as the sampling frequency for a frequency of 320 KHz, which is the logic cycle frequency. The logic cycle frequency is the time that it takes to complete all of the seven cycles of the TABLE II type. Each of the cycles within the logic cycle of TABLE II occurs at seven times the frequency of the complete logic cycle, that is, at 2.24 MHz. These values of the sampling frequency, the logic cycle frequency, and each subcycle frequency within the logic cycle are merely given as representative. Any frequencies can be selected. The particular preferred embodiment described operated with the basic clock frequency between 2 MHz and 3 MHz. Accordingly, the sampling frequency, $f_s$, for each voice is 1/112 the clock frequency of the Digitar Unit 35. In the particular embodiment described, the sampling frequency, $f_s$, is the same for all of the sixteen voices.

Command Sequences

The instrument of FIG. 5 and FIG. 6 assumes that the input unit 2 provides input commands in appropriate sequences. In the command sequences, amplitudes for defining the amplitude of a pluck are entered into the shift register 56 as part of a pluck mode and similarly, the pitch number for defining the pitch of each voice is entered as part of the decay mode for that particular voice. In this regard, it should be noted that two values for the command codes are prohibited for entering amplitudes or pitch numbers. The two values prohibited are $0_h0_h$ and $0_h1_h$. These values are prohibited since they are used to change between pitch/amplitude and parameter mode. These values are not particularly useful, however, as pitches because a period of 2 is the Nyquist frequency. Furthermore, these amplitudes can be obtained by using their inverses ($F_hF_h$ and $F_hE_h$). When doing a symmetric pluck, the maximum amplitude is $F_hF_h$ and the minimum is $8h0_h$. A typical example of command sequences for playing a maximum amplitude guitar note is shown in the following TABLE VI.

TABLE VI

| COMMAND | HEX | FUNCTION |
|---|---|---|
| 1 | $0_h0_h$ | Enter Parameter Mode (set lat 91 to 0) |
| 2 | $C_h5_h$ | Choose Voice 5 (load lat 90 with 5) |
| 3 | $7_h9_h$ | Start Plucking (read E lat 59) |
| 4 | $0_h1_h$ | p/a Mode (set lat 91 to 1) |
| 5 | $F_hF_h$ | Maximum Amplitude (load $F_hF_h$ into Pbot) |
| 6 | $0_h0_h$ | Enter Parameter Mode (set lat 91 to 0) |
| . | | . |
| . | | (Commands for Other Voices) |
| . | | . |
| K + 0 | $0_h0_h$ | Enter Parameter Mode (set lat 91 to 0) |
| K + 1 | $C_h5_h$ | Choose Voice 5 Again (load lat 90 with 5) |
| K + 2 | $0_h1_h$ | Back to p/a Mode (set lat 91 to 1) |
| K + 3 | $F_h0_h$ | Pitch Number 240 (load $F_h0_h$ into $56_1$) |
| K + 4 | $0_h0_h$ | Enter Parameter Mode (set lat 91 to 0) |
| K + 5 | $B_h8_h$ | Guitar Mode, Stretch 1, No Dither, no Cohere (load $B_h8_h$ into $55_1$) |

In order to demonstrate that the FIG. 5 instrument performs the Eq. (5) function, a simplified example is useful. The example uses a memory which has M storage locations where M is equal to 10. It is assumed that the pitch length, N, is equal to 6, and that d−1. The Write Pointer (considering only the high-order bits associated with a single voice) has the values 9, 8, 7, . . . , 1, 0.

It is assumed that the ten locations 0, 1, . . . , 9 in memory are initially filled with the data values A, B, . . . , J, respectively, where those data values have either a positive or negative quantity as determined by the 1 or 0 output, respectively, of a random bit generator. The logic cycles of the TABLE II type are numbered 1, 2, 3, . . . , 18, . . . corresponding only to the cycles for a single voice. Actually, there are sixteen times as many cycles, one for each voice, but only those cycles corresponding to a single voice have been numbered. With these simplified assumptions, the following TABLE VII represents the relationship between the Write Pointer, the Stored Data in the memory addresses associated with the Write Pointer, and the Read Pointer and the Read Pointer +1.

TABLE VII

| LOGIC CYCLE | WRITE POINTER | STORED DATA | READ POINTER | READ POINTER + 1 |
|---|---|---|---|---|
| | 9 | J | | |
| | 8 | I | | |
| | 7 | H | | |
| | 6 | G | | |
| | 5 | F | | |
| | 4 | E | | |
| | 3 | D | | |
| | 2 | C | | |
| | 1 | B | | |
| | 0 | A | | |
| 1 | 9 | (F + G)/2 | 5 | 6 |
| 2 | 8 | (E + F)/2 | 4 | 5 |
| 3 | 7 | (D + E)/2 | 3 | 4 |
| 4 | 6 | (C + D)/2 | 2 | 3 |
| 5 | 5 | (B + C)/2 | 1 | 2 |
| 6 | 4 | (A + B)/2 | 0 | 1 |
| 7 | 3 | [(F + G)/2 + A]/2 | 9 | 0 |
| 8 | 2 | [(E + F)/2 + (F + G)/2]/2 | 8 | 9 |
| 9 | 1 | [(D + E)/2 + (E + F)/2]/2 | 7 | 8 |
| 10 | 0 | [(C + D)/2 + (D + E)/2]/2 | 6 | 7 |
| 11 | 9 | [(B + C)/2 + (C + D)/2]/2 | 5 | 6 |
| 12 | 8 | [(A + B)/2 + (B + C)/2]/2 | 4 | 5 |
| 13 | 7 | [[(F + G)/2 + A]/2 + (A + B)/2]/2 | 3 | 4 |
| 14 | 6 | . | 2 | 3 |
| 15 | 5 | . | 1 | 2 |
| 16 | 4 | . | 0 | 1 |
| 17 | 3 | . | 9 | 0 |
| 18 | 2 | . | 8 | 7 |
| 19 | 1 | . | 7 | |
| 20 | 0 | . | | |

In TABLE VII, prior to Logic Cycle 1, the Stored Data is the data values A, B, . . . , J as previously described. Those values could be, for example, +8, −8, −8, +8, −8, +8, +8, +8, −8 and +8.

In Logic Cycle 1, storage location 9 designated by the Write Pointer is filled with the average of the quantities accessed at the addresses defined by the Read Pointer and the Read Pointer +1. The Read Pointer points to the address 5 which is stored with the data value F. The Read Pointer +1 points to the address 6 which is the data value G. Accordingly, in the Logic Cycle 1, the Stored Data is (F+G)/2, that is, 8 with the values previously selected for example.

In the Logic Cycle 2, the Stored Data is the quantity (E+F)/2, that is, 0. Similarly, each of the cycles is similar until in Logic Cycle 6, the storage location of the Write Pointer 4 is the quantity (A+B)/2, that is, 0.

In Logic Cycle 7, however, the Read Pointer points to the location 9 which was stored with the quantity (F+G)/2 in Logic Cycle 1. The Logic Cycle 7 is six cycles displaced from the Logic Cycle 1. The value averaged with the values stored in Logic Cycle 1 is the value stored in the cycle prior Write Pointer cycle 0, that is, the original data value A. The data value A is seven cycles displaced. Accordingly, the average between the 6-cycle displacement and the 7-cycle displacement is $6\frac{1}{2}$, that is, the pitch number is $N+\frac{1}{2}$ cycles.

Summary of Sixteen Voice Embodiment

The sixteen voice embodiment of FIG. 5 has each voice independently controllable for a value of pitch, determined by the pitch number N. Each voice has a sampling rate of approximately 20 KHz. Each sample time is sixteen voice cycles, each of which is a logic cycle comprised of seven clock cycles. The sampling frequency is 1/112 the clock frequency of the Digitar Unit.

Each voice can be in one of four modes, plucking, guitar decay, drum decay or harp decay. Each of the decay algorithms allows decay stretching during the decay operation with the stretching factor, s, equal to 1, 2, 4, 8, 16, 32, 64, or infinity. The factor s (which equals 1/d) multiplies the unstretched decay time by the value of s. The stretching is implemented by not incrementing the Read Pointer by +1 in probabilistically selected logic cycles.

During the plucking operation, the output to the digital/analog converter in the output unit 4 can be randomly amplitude A or 255−A, that is, the complement. The probability of inversion to 255−A is determined by the "PROBd" control to the E latch 59 of FIG. 6. Under these conditions, the digital/analog converter 9 of FIG. 2 is centered at 128.

In the guitar and drum instruments, the blend factors (one minus the probability of selecting the complement from the C latch) are 1 and $\frac{1}{2}$ respectively. The harp instrument is the drum with a blend factor of 0. A blend factor of 0 means the complement is always selected from the C latch. Therefore, the value in the wavetable is complemented on each pass thereby dropping the frequency an octave and leaving only the odd harmonics. This operation extends the range down an octave and adds a somewhat unusual timber to the higher octaves.

The dither bit, c7, is provided as an option to counteract the effects of round-off error.

The coherence bit, c4, is provided as a means of linking several voices. This technique can be used to increase the overall amplitude of a note over that which could be achieved by a single voice. It can also be used to provide a "swell" at the beginning of a note by initially exciting two coherent voices with equal and opposite amplitudes (complete cancellation hence silence) and later turning off the coherence bit.

In the FIG. 5 embodiment, the Digitar Unit 35 examines the input bus 7 from the input unit 2 only once per logic cycle (once every seven clock cycles during the Sp Cy cycle). Therefore, it is necessary for the control byte to be held at least seven cycles by the interface unit 6 before a new command is issued. The interface unit 6 can be any conventional device, such as a microprocessor chip, or a control register which is gated out by the SpCy signal from the Digitar Unit 35. Also, since the control memory in the Unit 35 utilizes the shift registers 55 and 56 in FIG. 6, commands that affect only one voice must be held until that voice has been stepped to the bottom location $\mathbf{55}_1$ or $\mathbf{56}_1$. Therefore, commands which are intended to affect a single voice should be held by the interface unit for at least 112 clock cycles.

FURTHER AND OTHER EMBODIMENTS

The sixteen voice embodiment previously described utilized a common Write Pointer and a different Read Pointer Calculated for each voice. Also, the sampling frequency $f_s$ was the same for each voice. While these conditions were convenient, they are not limitations of the present invention. More generally, a Write Pointer and a Read Pointer may be independently determined for each voice and each sampling frequency, $f_s$, and also be separately determined for each voice.

A further two-voice embodiment of the present invention exists when, in the FIG. 2 instrument, the modifier unit 14 is implemented as an 8080 microprocessor. In such a microprocessor embodiment, a program suitable for doing the modification is set forth in the following TABLE VIII. (In this example, the decay probability d is equal to 1.)

TABLE VIII

| S | LABEL | OP-CODE | ARGS | COMMENT |
|---|---|---|---|---|
| 1. | LOOP: | DCR(5) | L | bump the Read Pointer$_2$ H not changed, so pointer wraps around a 256 long buffer |
| 2. | | ADD(7) | M | add $y_{(n-N)}$ for voice 2 |
| 3. | | RAR(4) | | divide by two |
| 4. | | STAX(7) | B | store $y_n$ for voice 2 |
| 5. | | XCHG(4) | | set up HL to access voice 1 |
| 6. | | MOV(7) | B,M | read $x_n$ for voice 1 |
| 7. | | ADD(4) | B | add voices together |
| 8. | | OUT(10) | DAC | output both voices |
| 9. | | DCR(5) | L | decrement Read Pointer$_1$ |
| 10. | | MOV(5) | A,B | A loaded with $x_n$ |
| 11. | | ADD(7) | M | A loaded with A + $x_{n+1}$ |
| 12. | | RAR(4) | | divide by two |
| 13. | | MOV(5) | B,H | BC loaded with Write Pointer$_1$ |
| 14. | | DCR(5) | C | decrement Write Pointer$_{1,2}$ (and set condition codes) B not changed, so pointer wraps |
| 15. | CONT: | STAX(7) | B | store $X_{n+N}$ (voice 1) |
| 16. | START: | XCHG(4) | | setup HL for voice 2 |
| 17. | | MOV(7) | A,M | A loaded with $Y_{n-N-1}$ (voice 2) |
| 18. | | MOV(5) | B,H | BC loaded with Write Pointer$_2$ |
| 19. | END: | JNZ(10) | LOOP | every 256 samples check duration counter first compensating for extra time |
| 20. | | STAX(7) | B | SAVE $y_n = y_{n-N-1}$ (voice 2) |
| 21. | | DCR(5) | L | advance Read Pointer$_2$ |
| 22. | | DCR(5) | E | advance Read Pointer$_1$ |
| 23. | | DCR(5) | C | advance Write Pointer$_{1,2}$ |
| 24. | | LDA(13) | DUR | load duration counter |
| 25. | | DCR(5) | A | A loaded with A + 1 and set condition codes |
| 26. | | STA(13) | DUR | store decremented timer |
| 27. | | XCHG(4) | | setup HL for voice 1 |
| 28. | | MOV(5) | B,H | BC loaded with Write Pointer$_2$ |
| 29. | | MOV(7) | A,M | A loaded with $y_n$ (voice 1) |
| 30. | OUT: | JNZ(10) | CONT | if time not up, continue |
| 31. | | RET | | else done with notes |

In TABLE VIII, the entry point is START. The registers within the 8080 processor include a C latch, a DE register, and an HL register. DUR is a location in memory. The C register stores the low-order half of the Write Pointer. The DE register stores the Read Pointer$_2$ for voice 2. The HL register stores the Read Pointer$_1$ for voice 1. The C register stores the address of the current byte. Accordingly, the C register is stepped through 256 sample counts. The C register wraps around so that after counting through 256 counts, it decrements the duration time DUR and commences to count through a second set of 256 counts and so forth.

In TABLE VIII, the program routine is exited whenever the decay time has elapsed by proceeding from statement 30 to statement 31. If the decay time has not elapsed, the statement 30 jumps to the CONT statement 15 and continues processing.

The manner of determining the modification of the Eq. (5) type is that of a circular buffer technique. A common Write Pointer is shared by all voices. Each voice has a separate Read Pointer. Both the Write Pointer and the Read Pointer for each voice are stepped once per execution of the LOOP. The pitch number, $N_v$, for each voice, v, is not stored explicitly but rather is the difference between the Write Pointer and the Read Pointer$_v$ for that voice. The Write Pointer for voice 1 is formed using the B and C registers by moving contents of register H to B. The Write Pointer$_2$ is formed by moving the contents of register D to register B. The low-order byte in register C, in the register pairs BC is incremented or decremented without affecting the high-order byte B.

While the two voice embodiment is another example of the wavetable modification method of the present invention, the particular implementation, with current microprocessor technology, was adequate to handle two voices. Of course, as microprocessors with greater and greater capability are produced, then the circular buffer techniques described will be able to implement a greater number of voices.

An alternative to the circular buffer technique is a fixed sub-buffer technique. For example, a sub-buffer of size N is located as a portion of a larger memory of size G where N is typically less than G. The memory has locations from 0, 1, . . . , (N−1), (N), (N+1), . . . , (G−1) but only the N location 0, 1, . . . , (N−1) are active for any note specified by the pitch number N. The memory is addressed, for example by addresses which repeatedly count down from (N−1) to 0. Each count down from (N−1) to 0 provides a delay period defined by the pitch number N. After the address has been counted down to 0 each time, the address is restored to (N−1) and the count down begins again.

In the FIG. 5 instrument, the higher harmonics decay much faster than the lower harmonics, so that the tone decays to an almost pure sine wave, no matter what initial spectrum it has, eventually decaying to a constant value (silence).

Many alternative initial conditions can be specified. In concrete terms, this amounts to preloading the wavetable with appropriate values. The initial values can form a sine wave, triangle wave, or any other desired waveform. However, it is generally not necessary to do anything so complicated. Since it is desirable to have many high harmonics initially, the buffer in the FIG. 5 instrument is filled with random values. This operation produces a plucked-string sound very similar to a guitar. One fast way to fill the buffer is to use two-level randomness. Mathematically, the initial conditions are given as follows for n between N and 0:

$$y_n = +A, \text{ probability } \tfrac{1}{2} \qquad (29_1)$$

$$y_n = -A, \text{ probability } \tfrac{1}{2} \qquad (29_2)$$

Single-bit randomness of this form is easily produced with a feedback shift-register for the random bit generator 57 in FIG. 5. Such an embodiment is simpler than a full random word generator. The parameter A provides for amplitude control, with the amplitude of the output directly proportional to A.

After a note has been played with a particular voice, it is not always necessary to reload the buffer before playing the next note with that voice. If the first note has not decayed too far, the result is a slur between the two notes. Slurs resulting from an increase in N simulate, for example, the guitarist's "pull-off". Slurs resulting from a decrease in N simulate, for example, "hammer-on" playing techniques.

For slurs resulting from a decreasing value of N, the circular buffer and the fixed sub-buffer techniques perform essentially the same. Slurs resulting from an increasing value of N can perform differently for the two techniques. In the circular buffer technique, slurs tend to be smooth since increased values of N access recently stored samples. By way of contrast in the fixed sub-buffer technique for increased values of N, it is possible to access samples which were stored a long time ago and which may have been inactive for some indeterminate time. Therefore, increasing N slurs can be unpredictable for the fixed sub-buffer techniques.

If the initial buffer load is periodic with a period that divides N, the tone has a pitch that corresponds to the periodicity of the buffer load, which is a harmonic of N. This harmonic trick is implemented by filling half (or third, quarter, . . . ) of the buffer with randomness, then duplicating those samples to fill the rest of the buffer. Since short buffers (small N) decay much faster than long buffers, this provides a way to lengthen high-pitched notes, and efficiently simulates the guitarist's technique of playing "harmonics".

Shortening the decay times is harder to achieve than lengthening them. One possibility is to change the recurrence to one that smooths out the waveform faster. For example, $$y_n = x_n + [y_{n-N-1} + 2y_{n-N} + y_{n-N+1}]/4 \quad (30)$$

The arithmetic of Eq. (30) takes more compute power, so the shortened decay time is usually offset by an increase in the time it takes to compute a sample. The variations describe below can be applied to the Eq. (30) recurrence as easily as to the Eq. (5) recurrence.

A simple variation of the basic Eq. (5) recurrence yields drum timbres. The simplest description of the drum variant is a probabilistic recurrence relation:

$$y_n = +\tfrac{1}{2}(y_{n-N} + y_{n-N-1}), \text{ probability } b \quad (31_1)$$

$$y_n = -\tfrac{1}{2}(y_{n-N} + y_{n-N-1}), \text{ probability } (1-b) \quad (31_2)$$

The normal initial conditions are two-level randomness.

The parameter b is called the blend factor. With a blend factor of one, the recurrence reduces to the basic plucked-string recurrence, with N controlling the pitch. With a blend factor of one-half, the sound is drum-like. Intermediate values produce sounds intermediate between plucked string and drum, some of which are quite interesting musically. Values less than $\frac{1}{2}$ are also interesting. Note that $b=\frac{1}{2}$ requires only a single bit of randomness on each sample. Using arbitrary values for b requires a comparison with a full random word.

For b close to $\frac{1}{2}$, the buffer length does not control the pitch of the tone, as the sound is aperiodic. Instead it controls the decay time of the noise burst. For large N (around 200) and a sampling period of about 50 microseconds, the effect is that of a snare drum. For small N (around 20), the effect is that of a tom-tom. Intermediate values provide intermediate timbres, allowing smooth transition from one drum sound to another. For these drum sounds, the buffer can be filled with a constant (A) initially, as the recurrence will create the randomness itself. The blend factor is another example of a probabilistic wavetable modification.

Using small word sizes (like 8 bits) makes round-off error a problem. In the recurrence described, round-off error is not random, but a consistent rounding-down of the samples. This effect significantly reduces the decay time of the fundamental frequency (when compared to the theoretical decay time, or the decay time when the recurrence is computed with much larger word sizes). The effect can be almost eliminated by randomly adding 0 or 1 to $y_{n-N}+y_{n-N-1}$ before dividing by 2. This bit-twiddle technique lengthens the final decay of the fundamental roughly back to its theoretical decay time, without appreciably lengthening the initial attack of the tone.

The blend factor b can also be used with decay probabilities less than 1 to stretch out the decay. For drums, this has the effect of increasing the "snare" sound, allowing smaller values of N to be used. The recurrence relation for stretched sounds is $$y_n = +y_{n-N} \text{ probability } b(1-d) \quad (32_1)$$

$$y_n = -y_{n-N} \text{ probability } (1-b)(1-d) \quad (32_2)$$

$$y_n = +\tfrac{1}{2}(y_{n-N} + y_{n-N-1}) \text{ probability } bd \quad (32_3)$$

$$y_n = -\tfrac{1}{2}(y_{n-N} + y_{n-N-1}) \text{ probability } (1-b)d \quad (32_4)$$

The parameter d is the familiar decay probability. Sometimes for convenience we talk about the stretch factor $s=1/d$. Note that the decay probability and blend factors are independent, so the recurrence can be implemented with two separate tests, and no multiplies are needed. The decay time of the tone is approximately proportional to s. The pitch of the sound is also affected by d, as the period is now approximately $N+d/2$. The optimum choice for d depends on the sampling rate, on N, and on the effect desired. By choosing d approximately proportional to N or $N^2$, the decay rates of the higher pitches can be made comparable to the decay rates for the lower ones. Note that for $d=1$ the recurrence relation simplifies to that of the unstretched version. For $d=0$ the sound does not decay. If $b=1$, this is the wavetable synthesis algorithm of Eq. (2), if $b=\frac{1}{2}$, white noise is produced.

If drum sounds are not desired, b can be set to one, simplifying the recurrence. With random buffer loads, the sound is a plucked string, with decay time proportional to s. If non-random buffer loads are used with $b=1$ and large values of s, woodwind-like sounds can be produced. In this case the overall amplitude is not decaying fast enought to be noticed, but the tone still changes realistically with time because of the probabilistic wavetable modification (the decay of the high harmonics is fast enough to be noticed).

The embodiments described have employed a single sampling frequency, $f_s$, for all of one or more voices. Of course, $f_s$ can be made different for each voice. For example, the clock frequency for the clock unit (CLK) in FIG. 6 can be made a variable by a program command of a quantity Q from bus 47 (or otherwise) which provides control of the frequency to the control logic 71. The clock frequency is divided by Q and a different value of Q can be provided for each voice so that each voice has a different sampling frequency. Also, the sampling frequency for any voice can vary as a function of time by varying Q as a function of time. In one variation, the contents of the wavetable are output at a different sampling frequency than that at which it is being probabilistically modified.

The embodiments of the present invention have been implemented using a single digital-to-analog converter for all voices in a multi-voice instrument. In an alternative embodiment, each voice may have its own digital-to-analog converter and the analog outputs from a plurality of such converters can then be summed, for example, in a summing amplifier before the low-pass filter 10 of FIG. 2.

While the invention has been particularly shown and described with reference to preferred embodiments thereof, it will be understood by those skilled in the art that the foregoing and and other changes in form and details may be made therein without departing from the spirit and scope of the invention.

What is claimed is:

1. A musical instrument for producing musical sound comprising, input means for specifying a musical sound to be generated, wavetable-modification generator means for generating by wavetable modification an output signal representing the musical sound to be produced, including a wavetable unit for cyclically storing data values for a delay period N, including initial value means for storing input data values into said wavetable unit with said input data values having amplitudes determined at least in part randomly, including a modifier unit for combining two or more delayed data values from said wavetable unit to form a modified data value, and including selection means for selecting the modified data value as a stored value stored back into the wavetable unit for subsequent delay by the period N where the stored value forms the output signal, means for selecting the stored value as the output signal at a rate independent of the pitch of the musical sound to be produced, an output unit responsive to said output signal to produce the musical sund.

2. The musical instrument of claim 1 wherein said selection means includes means for selecting said modified data value or a delayed data value stochastically based upon a predetermined probability, d.

3. The instrument of claim 2 wherein said modifier unit includes an arithmetic unit for summing said two or more delayed data values from said wavetable unit and for dividing the summed data value by a number greater than unity to form said modified data value.

4. The instrument of claim 3 wherein said number greater than unity is 2 whereby said two or more delayed data values from said wavetable unit are averaged.

5. The instrument of claim 2 wherein said value has an amplitude $y_n$ at a sample time n greater than or equal to 0 where $y_n$ is given as follows, $$y_n = \begin{cases} x_n \text{ for } 0 \leqq n < M; \\ [y_{n-N} + y_{n-(N+1)}]/2 \text{ for } n \geqq M \text{ and } r_n < d; \\ y_{n-N} \text{ for } n \geqq M \text{ and } r_n \geqq d; \end{cases}$$

where $y_{n-N}$ is the data value output from the wavetable after delay of N and where $y_{n-(N+1)}$ is the data value output from the wavetable after a delay of N+1 and where $x_n$ is an input data value at sample time n having a signal amplitude loaded for an initial number of samples M into the wavetable and where $r_n$ is a random number between 0 and 1 generated at sample time n.

6. The instrument of claim 5 wherein said output signal, at sample time n, is the data value having the amplitude $y_n$.

7. The instrument of claim 5 wherein said wavetable unit is a random access memory, wherein the data value, $y_n$, is stored in said memory at a Write Pointer address and wherein the data value $y_{n-N}$ is stored in said memory at a Read Pointer address, and wherein said Write Pointer address and said Read Pointer address are offset by a number of addresses equal to the number, N.

8. The instrument of claim 7 wherein the data value $y_{n-(N+1)}$ is stored in said memory at a Read Pointer +1 address which is offset from said Read Pointer address by +1.

9. The instrument of claim 5 wherein the values of $x_n$ initially stored in said wavetable represent "white noise".

10. The instrument of claim 9 wherein said values of $x_n$ are given as follows:

$$x_n = Au_n$$

where $u_n$ is determined as +1 or −1 as a function of the output of a random number generator and where A is some amplitude.

11. The instrument of claim 5 including control means for producing the values of $y_n$ for the output signal at a sampling frequency, $f_s$, and wherein the fundamental frequency of the sound produced for a pitch number N is approximately equal to $f_s/(N+d/2)$.

12. The instrument of claim 7 including means for storing said Write Pointer address, means for storing the pitch number, N, as an address offset, means for calculating said Read Pointer address by summing said Write Pointer address and N, and means for sequentially changing said Write Pointer address to a new address for each value of $y_n$ stored.

13. The instrument of claim 12 wherein means for sequentially changing said Write Pointer address includes means for decrementing said Write Pointer address.

14. The instrument of claim 7 including means for storing said Write Pointer address, means for storing said Read Pointer address offset by an integer proportioned to N from said Write Pointer address, and means for sequentially changing said Write Pointer address and said Read Pointer address whereby the offset between said Write Pointer address and Read Pointer address remains the same.

15. The instrument of claim 2 wherein said generator means includes means for generating modified data values at a sampling frequency.

16. The instrument of claim 2 wherein said data values are digital and wherein said output unit includes a digital-to-analog converter, a low-pass filter, an amplifier and a speaker for producing the musical sound in response to said output signal.

17. The instrument of claim 1 wherein said wavetable modification generator generates musical sound for a plurality of voices, wherein said input unit includes means for specifying one or more of said voices, wherein said wavetable modification generator includes means for producing output signals representing the sound for each of said voices by probabilistic wavetable modification, and wherein said output unit in response to said output signals concurrently produces said musical sounds for all of said voices.

18. The instrument of claim 1 wherein said wavetable unit cyclically stores data values for a plurality of voices, each having a delay period specified by an independent pitch number, N, wherein said modifier unit modifies two or more delayed data values for each voice from said wavetable unit to form a modified data value, for each voice, and wherein said generator includes means for storing either the modified data value or a delayed data value for each voice back into the wavetable unit as a stored data value for subsequent delay by the corresponding N where the stored data value for each voice forms the output signal.

19. The instrument of claim 18 including means for storing and updating a Write Pointer each cycle to specify the location in the wavetable at which the stored data value for each voice is to be stored, and including means for storing a delay period N for each voice, and means for determining a Read Pointer for each voice to designate the location of the delayed data values for each voice in the wavetable memory.

20. The instrument of claim 19 wherein said Write Pointer is common for all of said voices and wherein said generator includes means for adding the pitch number N for each voice to the Write Pointer to provide the Read Pointer for each voice.

21. The instrument of claim 20 wherein the wavetable is a random access memory, wherein the stored data value for each voice is stored in said memory at a Write Pointer address unique to that corresponding voice and wherein the delayed data values are stored in memory locations determined by a Read Pointer address for each voice and wherein said Write Pointer and Read Pointer addresses for each voice are offset by a number equal to the pitch number, N for each voice.

22. The instrument of claim 21 wherein the Write Pointer address includes a low-order field for uniquely identifying each different voice and includes a high-order field for identifying the location within a portion of the memory associated with the voice identified in the corresponding low-order field.

23. The instrument of claim 22 wherein said generator includes means for decrementing said Write Pointer each time a data value is stored at the location specified by said Write Pointer.

24. The instrument of claim 23 wherein the sampling frequency, $f_s$, is the same for each voice.

25. The instrument of claim 24 including means for providing said data values at a logic cycle frequency which is the number of voices times $f_s$.

26. The instrument of claim 25 wherein the output unit includes a digital-to-analog converter for receiving each new data value for each voice and includes a low pass filter for filtering the analog value from said converter and wherein said converter receives a new data value at said logic cycle frequency whereby the output from said low pass filter is a signal representing the musical sound for all of the voices.

27. The instrument of claim 18 including means for storing a Write Pointer and means for storing a Read Pointer for each voice, said Write Pointer having an address offset from said Read Pointer for each voice by the pitch number N for each voice, respectively, and including means for updating both said Write Pointer and said Read Pointer concurrently for each voice whereby the offset N between the Read Pointer and the Write Pointer for each voice is maintained.

28. A musical instrument for producing musical sound comprising, input means for specifying a musical sound to be generated, wavetable-modification generator means for generating by wavetable modification an output signal representing the musical sound to be produced, including a wavetable unit for cyclically storing data values for a delay period defined by a pitch number N, including a modifier unit for combining two or more delayed data values from said wavetable unit to form a modified data value, and including selection means for selecting the modified data value or a delayed data value stochastically based upon a predetermined probability as a stored value stored back into the wavetable unit for subsequent delay by the period N where the stored value forms the output signal, an output unit responsive to said output signal to produce the musical sound.

29. The instrument of claim 28 wherein said predetermined probability equals unity whereby the stored value is always the modified data value, and has an amplitude $y_n$ at a sample time n where $y_n$ is given as follows, $$y_n = x_n + [y_{n-N} + y_{n-(N+1)}]/2$$

where $y_{n-N}$ is the data value output from the wavetable after delay of N and where $y_{n-(N+1)}$ is the data value output from the wavetable after a delay of N+1 and where $x_n$ is an input data value at sample time n having a signal amplitude initially loaded into the wavetable.

30. The instrument of claim 29 including means for storing the modified data value, $y_n$, in said memory at a Write Pointer address, including means for storing the data value $y_{n-N}$ in said memory at a Read Pointer address, including means for storing the data value $y_{n-(N+1)}$ in said memory at a Read Pointer +1 address which is offset from said Read Pointer address by +1 and wherein said Write Pointer address and said Read Pointer address are offset by a number of addresses equal to the pitch number N.

31. The instrument of claim 30 wherein said values of $x_n$ represent white noise and are given as follows:

$$x_n = Au_n, \text{ when } n=0,1,2,\ldots,(N-1)$$

$$x_n = 0, \text{ when } n \geqq N$$

where $u_n$ is determined as +1 or −1 as a function of the output of a random number generator and where A is some amplitude.

32. The instrument of claim 29 including control means for producing the values of $y_n$ for the output signal at a sampling frequency, $f_s$, whereby the fundamental frequency of the sound produced for the pitch number N is approximately equal to $f_s/(N+\frac{1}{2})$.

33. The instrument of claim 30 including means for storing said Write Pointer address, means for storing the pitch number N as an address offset, means for calculating said Read Pointer address by summing said Write Pointer address and N, and means for sequentially changing said Write Pointer address to a new address for each value of $y_n$ stored.

34. The instrument of claim 30 including means for storing said Write Pointer address, means for storing said Read Pointer address offset by an integer proportional to N from said Write Pointer address, and means for sequentially changing said Write Pointer address and said Read Pointer address whereby the offset between said Write Pointer address and Read Pointer address remains substantially the same.

35. The instrument of claim 28 wherein said wavetable modification generator generates musical sound for a plurality of voices, wherein said input unit includes means for specifying one or more of said voices, wherein said wavetable modification generator includes means for producing output signals representing the sound for each of said voices by probabilistic wavetable modification, and wherein said output unit in response to said output signals concurrently produces said musical sounds for all of said voices.

36. A wavetable-modification generator for use with a musical instrument having an input unit for specifying a musical sound to be generated and having an output unit responsive to an output signal to produce musical sound, said generator comprising, a digital wavetable unit having a random access memory for cyclically storing data values for a delay period N, initial value means for storing input data values into said wavetable unit with said input data values having amplitudes determined at least in part randomly, a modifier unit having an arithmetic unit for summing two or more delayed data values from said wavetable unit and for dividing the summed data value by a number greater than unity to form a modified data value, and means for storing the modified data value back into the memory for subsequent delay by the period N where the modified data value forms said output signal representing the musical sound to be produced.

37. The generator of claim 36 wherein said modified data value has an amplitude $y_n$ at a sample time n where $y_n$ is given as follows, $$y_n = x_n + [y_{n-N} + y_{n-(N+1)}]/2$$

where $y_{n-N}$ is the data value output from the wavetable after delay of N and where $y_{n-(N+1)}$ is the data value output from the wavetable after a delay of N+1 and where $x_n$ is an input data value at sample time n having a signal amplitude initially loaded into the wavetable.

38. The instrument of claim 28 including control means connected to said modifier unit for altering the manner in which said modified data value is formed.

39. The instrument of claim 38 wherein said control means includes a random number generator connected to control the selection of said delayed data values in accordance with a predetermined statistical probability, d, and means for providing said probability, d.

40. A musical instrument for producing musical sound comprising, input means for specifying a musical sound to be generated, wavetable modification generator means including, a wavetable unit for cyclically storing a plurality of data values for a delay period defined by a pitch number N, a modifier unit for combining after said delay period delayed first and second ones of said data values from said wavetable unit to form a modified data value, and selection means responsive to a selection signal for selecting either the modified data value or the first one of said delayed data values as a stored data value for storage into the wavetable unit for delay by said delay period where said stored data value forms the output signal, and selection signal means for generating said selection signal to cause said selection means to select the modified data value or the delayed first one of said data values stochastically with a probability, d, an output unit responsive to said output signal to produce the musical sound.

41. A musical instrument for producing musical sound comprising, input means for specifying a musical sound to be generated, wavetable-modification generator means for generating by wavetable modification an output signal representing the musical sound to be produced, including a wavetable unit for cyclically storing data values for a delay period, including initial value means for storing input data values into said wavetable unit with said input data values having amplitudes determined at least in part randomly, including a modifier unit for combining two or more delayed data values from said wavetable unit to form a modified data value, and including selection means for selecting the modified data value as a stored value stored back into the wavetable unit for subsequent delay where the stored value forms the output signal, an output unit responsive to said output signal to produce the musical sound.

42. A wavetable-modification generator for use with a musical instrument having an input unit for specifying a musical sound to be generated and having an output unit responsive to an output signal to produce musical sound said generator comprising, a digital wavetable unit having a random access memory for cyclically storing data values for a delay period, initial value means for storing input data values into said wavetable unit with said input data values having amplitudes determined at least in part randomly, a modifier unit having an arithmetic unit for summing two or more delayed data values from said wavetable unit and for dividing the summed data value by a number greater than unity to form a modified data value, and means for storing the modified data value back into the memory for subsequent delay where the modified data value forms said output signal representing the musical sound to be produced.

43. A musical instrument for producing musical sound comprising, input means for specifying a musical sound to be generated, wavetable-modification generator means for generating by wavetable modification an output signal representing the musical sound to be produced, including a wavetable unit for cyclically storing data values for a delay period, including a modifier unit for combining two or more delayed data values from said wavetable unit to form a modified data value, and including selection means for selecting the modified data value as a stored value stored back into the wavetable unit for subsequent delay where the stored value forms the output signal, an output unit responsive to said output signal to produce the musical sound.

44. A wavetable-modification generator for use with a musical instrument having an input unit for specifying a musical sound to be generated and having an output unit responsive to an output signal to produce musical sound said generator comprising, a digital wavetable unit having a random access memory for cyclically storing data values for a delay period, a modifier unit having an arithmetic unit for summing two or more delayed data values from said wavetable unit and for dividing the summed data value by a number greater than unity to form a modified data value, and means for storing the modified data value back into the memory for subsequent delay where the modified data value forms said output signal representing the musical sound to be produced.

* * * * *